US011233310B2

(12) United States Patent
Rogers et al.

(10) Patent No.: US 11,233,310 B2
(45) Date of Patent: Jan. 25, 2022

(54) LOW-PROFILE CONFORMAL ANTENNA

(71) Applicant: The Boeing Company, Chicago, IL (US)

(72) Inventors: John E. Rogers, Owens Cross Roads, AL (US); John D. Williams, Decatur, AL (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 15/882,819

(22) Filed: Jan. 29, 2018

(65) Prior Publication Data

US 2019/0237844 A1 Aug. 1, 2019

(51) Int. Cl.

| | |
|---|---|
| ***H01Q 1/12*** | (2006.01) |
| ***H01Q 9/04*** | (2006.01) |
| ***H01Q 1/38*** | (2006.01) |
| ***H01Q 1/28*** | (2006.01) |

(52) U.S. Cl.

CPC ..... *H01Q 1/125* (2013.01); *H01Q 1/28* (2013.01); *H01Q 1/38* (2013.01); *H01Q 9/0407* (2013.01)

(58) Field of Classification Search

CPC ..... H01Q 1/125; H01Q 1/28; H01Q 1/38; H01Q 9/0407; H01Q 1/36; H01Q 1/422; H01Q 1/425; H01Q 13/28; H01Q 15/12

See application file for complete search history.

(56) References Cited

U.S. PATENT DOCUMENTS

| | | | | |
|---|---|---|---|---|
| 2,677,766 A | | 5/1954 | Litchford | |
| 3,404,405 A | | 10/1968 | Young | |
| 3,665,480 A | * | 5/1972 | Fassett | H01Q 9/0435 343/754 |
| 3,696,433 A | | 10/1972 | Killion et al. | |
| 3,729,740 A | | 4/1973 | Nakahara et al. | |

(Continued)

FOREIGN PATENT DOCUMENTS

| | | | | |
|---|---|---|---|---|
| CN | 105846051 A | * | 8/2016 | H01Q 1/24 |
| EP | 2573872 A1 | | 3/2013 | |

(Continued)

OTHER PUBLICATIONS

Benjamin S. Cook et al. "Multilayer Inkjet Printing of Millimeter-Wave Proximity-Fed Patch Arrays on Flexible Substrates", IEEE Antennas and Wireless Propagation Letters, vol. 12, 2013, pp. 1351-1354.

(Continued)

*Primary Examiner* — Hoang V Nguyen
*Assistant Examiner* — Bamidele A Jegede
(74) *Attorney, Agent, or Firm* — Moore Intellectual Property Law, PLLC

(57) ABSTRACT

A low-profile conformal antenna ("LPCA") is disclosed. The LPCA includes a plurality of dielectric layers forming a dielectric structure. The plurality of dielectric layers includes a top dielectric layer that includes a top surface. The LPCA further includes an inner conductor, a patch antenna element ("PAE"), and an antenna slot. The inner conductor is formed within the dielectric structure, the PAE is formed on the top surface of the top dielectric layer, and the antenna slot is within the PAE. The LPCA is configured to support a transverse electromagnetic ("TEM") signal within the dielectric structure.

20 Claims, 16 Drawing Sheets

(56) References Cited

U.S. PATENT DOCUMENTS 4,197,545 A * 4/1980 Favaloro ..... H01Q 13/106 343/700 MS
4,232,321 A 11/1980 Ohm
4,313,120 A 1/1982 Westerman
4,835,538 A * 5/1989 McKenna ..... H01Q 9/0414 343/700 MS
4,862,185 A 8/1989 Andrews et al.
5,005,019 A * 4/1991 Zaghloul ..... H01Q 9/0414 343/700 MS
5,043,738 A * 8/1991 Shapiro ..... H01Q 5/385 343/700 MS
5,218,322 A 6/1993 Allison et al.
5,287,116 A * 2/1994 Iwasaki ..... H01Q 9/0442 343/700 MS
5,353,035 A * 10/1994 Del Castillo Cuervo-Arango ..... H01Q 9/0457 343/700 MS
5,421,848 A 6/1995 Maier et al.
5,448,250 A * 9/1995 Day ..... H01Q 1/1271 343/700 MS
5,473,336 A 12/1995 Harman et al.
5,581,267 A * 12/1996 Matsui ..... H01Q 19/10 343/753
5,726,666 A 3/1998 Hoover et al.
5,914,693 A * 6/1999 Takei ..... H01Q 13/16 343/700 MS
5,977,710 A * 11/1999 Kuramoto ..... H01Q 9/0414 343/700 MS
5,977,924 A 11/1999 Takei et al.
5,982,256 A 11/1999 Uchimura et al.
6,003,808 A * 12/1999 Nguyen ..... B64F 5/60 244/1 R
6,005,520 A 12/1999 Nalbandian et al.
6,133,882 A * 10/2000 LaFleur ..... H01Q 1/38 343/700 MS
6,150,982 A * 11/2000 Bergstedt ..... H01Q 1/243 343/700 MS
6,191,740 B1 * 2/2001 Kates ..... H01Q 1/38 343/700 MS
6,198,453 B1 3/2001 Chew
6,252,549 B1 * 6/2001 Derneryd ..... H01Q 1/32 343/700 MS
6,285,325 B1 9/2001 Nalbandian et al.
6,320,543 B1 * 11/2001 Ohata ..... H01Q 9/0407 343/700 MS
6,593,887 B2 * 7/2003 Luk ..... H01Q 1/40 343/700 MS
6,646,609 B2 * 11/2003 Yuasa ..... H01Q 1/243 343/700 MS
6,664,931 B1 12/2003 Nguyen et al.
6,777,771 B1 * 8/2004 Marumoto ..... H01Q 1/36 257/500
7,057,564 B2 * 6/2006 Tsai ..... H01Q 9/0407 343/700 MS
7,385,462 B1 6/2008 Epp et al.
7,471,248 B2 12/2008 Popugaev et al.
7,471,258 B2 12/2008 Hsu et al.
8,197,473 B2 6/2012 Rossetto et al.
8,384,499 B2 2/2013 Suzuki et al.
8,665,142 B2 3/2014 Shijo et al.
8,797,222 B2 * 8/2014 Chamseddine ..... H01Q 21/24 343/767
8,860,532 B2 10/2014 Gong et al.
8,952,521 B2 * 2/2015 Wojnowski ..... H01L 21/76802 257/698
9,002,571 B1 * 4/2015 Gribble ..... G06Q 10/0637 701/33.2
9,325,058 B2 * 4/2016 Le ..... H01Q 1/287
9,437,184 B1 9/2016 Swett
9,496,613 B2 11/2016 Sawa
9,979,459 B2 5/2018 Savage et al.
10,283,832 B1 5/2019 Chayat et al.
10,291,312 B2 5/2019 Savage et al.
10,522,916 B2 12/2019 Rogers et al.
10,777,905 B2 9/2020 Diehl et al.
2002/0047803 A1 * 4/2002 Ishitobi ..... H01Q 9/0407 343/700 MS
2003/0006941 A1 1/2003 Ebling et al.
2003/0043086 A1 3/2003 Schaffner et al.
2003/0103006 A1 * 6/2003 Yamada ..... H01L 23/66 343/700 MS
2004/0090369 A1 * 5/2004 McCarrick ..... H01Q 1/38 343/700 MS
2004/0104852 A1 * 6/2004 Choi ..... H01Q 21/065 343/700 MS
2004/0196203 A1 * 10/2004 Lier ..... H01Q 1/081 343/824
2004/0239565 A1 * 12/2004 Brachat ..... H01Q 9/0414 343/700 MS
2004/0252058 A1 * 12/2004 Rawnick ..... H01Q 9/0407 343/700 MS
2005/0057415 A1 * 3/2005 Rawnick ..... H01Q 9/0442 343/795
2005/0195110 A1 * 9/2005 Lin ..... H01Q 9/0414 343/700 MS
2006/0001574 A1 * 1/2006 Petros ..... H01Q 9/0407 343/702
2006/0044188 A1 * 3/2006 Tsai ..... H01Q 9/0407 343/700 MS
2006/0098272 A1 5/2006 Lerner et al.
2007/0026567 A1 * 2/2007 Beer ..... G01S 19/36 438/106
2007/0126641 A1 * 6/2007 Saily ..... H01Q 9/0435 343/700 MS
2007/0216596 A1 9/2007 Lewis et al.
2007/0279143 A1 * 12/2007 Itsuji ..... H03B 7/08 331/185
2008/0136553 A1 * 6/2008 Choi ..... H01Q 21/065 333/32
2008/0252544 A1 * 10/2008 Irion ..... H01Q 9/0457 343/834
2009/0046017 A1 * 2/2009 Foo ..... H01Q 1/40 343/700 MS
2009/0046029 A1 * 2/2009 Nagai ..... H01Q 9/0407 343/850
2009/0058731 A1 * 3/2009 Geary ..... H01Q 9/0414 343/700 MS
2009/0218407 A1 * 9/2009 Rofougaran ..... H04B 5/0093 235/492
2009/0289858 A1 * 11/2009 Olsson ..... H01Q 1/243 343/702
2010/0001916 A1 1/2010 Yamaguchi et al.
2010/0073238 A1 * 3/2010 Jun ..... H01Q 9/0457 343/700 MS
2010/0177011 A1 * 7/2010 Sego ..... H01Q 1/28 343/893
2010/0177012 A1 * 7/2010 Morrow ..... H01Q 21/0025 343/893
2010/0181379 A1 * 7/2010 Okegawa ..... G06K 19/07749 235/488
2010/0245155 A1 * 9/2010 Miyazato ..... H01P 3/081 342/104
2011/0025574 A1 * 2/2011 Tiezzi ..... H01Q 21/065 343/824
2011/0062234 A1 * 3/2011 Oishi ..... H01Q 1/2208 235/439
2011/0090129 A1 * 4/2011 Weily ..... H01Q 1/38 343/770
2011/0165839 A1 * 7/2011 Kawamura ..... H04B 10/501 455/41.1
2011/0168788 A1 * 7/2011 Sonoda ..... H01Q 9/24 235/492
2012/0235848 A1 * 9/2012 Bruno ..... H01Q 3/46 342/16
2012/0242547 A1 * 9/2012 Fujii ..... H01Q 9/0414 343/700 MS
2012/0276856 A1 * 11/2012 Joshi ..... A61N 1/37229 455/73

(56) References Cited

U.S. PATENT DOCUMENTS

2012/0287019 A1* 11/2012 Sudo ..... H01Q 9/045 343/904
2012/0299783 A1* 11/2012 Lee ..... H01Q 1/2291 343/700 MS
2012/0306698 A1* 12/2012 Warnick ..... H01Q 21/065 342/372
2013/0063310 A1* 3/2013 Mak ..... H01Q 21/08 343/700 MS
2013/0187830 A1* 7/2013 Warnick ..... H01Q 9/0428 343/893
2013/0258490 A1 10/2013 Ishihara
2013/0278467 A1* 10/2013 Dassano ..... H01Q 9/0414 343/700 MS
2014/0110841 A1* 4/2014 Beer ..... H01L 23/49816 257/738
2014/0151860 A1* 6/2014 Nakamura ..... H01L 23/66 257/664
2014/0152509 A1* 6/2014 Liu ..... H01L 24/97 343/700 MS
2014/0168014 A1* 6/2014 Chih ..... H01L 21/56 343/700 MS
2014/0354411 A1* 12/2014 Pudenz ..... H01Q 9/0407 340/10.1
2015/0194730 A1* 7/2015 Sudo ..... H01Q 5/378 343/905
2015/0236425 A1* 8/2015 Sudo ..... H01Q 9/0407 343/700 MS
2015/0249283 A1* 9/2015 Watanabe ..... H01Q 1/42 343/702
2015/0349421 A1* 12/2015 Sharawi ..... H01Q 21/065 342/373
2015/0364823 A1* 12/2015 Hashimoto ..... H01Q 9/0407 343/700 MS
2015/0380789 A1* 12/2015 Jakoby ..... H01P 1/184 343/905
2016/0036128 A1* 2/2016 Werner ..... H01Q 9/045 343/850
2016/0036130 A1* 2/2016 Hsu ..... H01Q 9/0457 343/848
2016/0056541 A1 2/2016 Tageman et al.
2016/0056544 A1* 2/2016 Garcia ..... H01Q 1/38 343/725
2016/0087333 A1* 3/2016 Tong ..... H01Q 1/40 343/873
2016/0126617 A1* 5/2016 Jan ..... H01Q 9/0414 343/848
2016/0126637 A1* 5/2016 Uemichi ..... H01Q 13/22 343/771
2016/0190696 A1* 6/2016 Preradovic ..... H01Q 9/0428 343/700 MS
2016/0190697 A1* 6/2016 Preradovic ..... H01Q 1/38 343/700 MS
2016/0218420 A1* 7/2016 Leung ..... H01Q 21/065
2016/0261036 A1* 9/2016 Sato ..... G01S 7/4026
2016/0294045 A1* 10/2016 Shiu ..... H01Q 1/38
2016/0295335 A1* 10/2016 Vajha ..... H01Q 1/36
2016/0301129 A1* 10/2016 Ying ..... H01Q 5/10
2016/0322703 A1 11/2016 Jesme et al.
2016/0322714 A1* 11/2016 Ying ..... H01Q 21/30
2016/0344093 A1* 11/2016 Tagi ..... H01Q 1/38
2016/0344098 A1* 11/2016 Ming ..... H01Q 3/34
2017/0054217 A1* 2/2017 Hashimoto ..... H01Q 13/10
2017/0084971 A1 3/2017 Kildal et al.
2017/0133756 A1 5/2017 Eastburg et al.
2017/0237181 A1* 8/2017 Chen ..... H01Q 21/245 343/702
2017/0250466 A1* 8/2017 Schlatter ..... H05K 1/185
2019/0067805 A1 2/2019 Rogers et al.
2019/0086581 A1 3/2019 Diehl et al.
2019/0115645 A1* 4/2019 Chang ..... H01Q 1/523
2019/0190110 A1* 6/2019 Clark ..... H01P 5/028
2019/0237844 A1 8/2019 Rogers et al.
2019/0237876 A1 8/2019 Rogers et al.
2020/0067165 A1 2/2020 Rogers
2020/0067193 A1* 2/2020 Zhinong ..... H01Q 9/0414
2020/0067201 A1 2/2020 Rogers

FOREIGN PATENT DOCUMENTS

EP 2750246 A1 7/2014
EP 3012916 A1 4/2016
JP 2003283239 A * 10/2003 ..... H01Q 13/08
KR 100449846 B1 * 9/2004 ..... H01Q 13/08
WO 20150102938 7/2015

OTHER PUBLICATIONS

D. M. Pozar, "Microstrip Antenna Aperture Coupled to a Microstripline", Electronics Letters Jan. 17, 1985 vol. 21 No. 2, pp. 49-50.
D.M. Pozar et al., "Increasing the Bandwidth of a Microstrip Antenna by Proximity Coupling", Electronics Letters Apr. 9, 1387 vol. 23 No. 8, pp. 368-369.
David M. Pozar et al., "A Rigorous Analysis of a Microstripline Fed Patch Antenna", IEEE Transactions on Antennas and Propagation, vol. AP-35, No. 12, Dec. 1987, pp. 1343-1350.
Hisao Iwasaki, "A Circularly Polarized Small-Size Microstrip Antenna with a Cross Slot", IEEE Transactions on Antennas and Propagation, vol. 44, No. 10, Oct. 1996, pp. 1399-1401.
Marat Davidowitz et al., "Rigorous Analysis of a Circular Patch Antenna Excited by a Microstrip Transmission Line", IEEE Transactions on Antennas and Propagation, vol. 37, No. 8, Aug. 1989, pp. 949-958.
Allen, J. W. et al., "Design and fabrication of an RF GRIN lens 3D printing technology", Proc. of SPIE, vol. 8624, Feb. 20, 2013, 8 pgs.
Cheng, Yu Jian et al., "W-band Large-Scale High-Gain Planar Integrated Antenna Array," IEEE Transactions on Antennas and Propagation, vol. 62, No. 6, Jun. 2014, pp. 3370-3373.
Delgado, Guillermo et al., "Scanning Properties of Teflon Lenses," Microwave and Optical Technology Letters, vol. 11, No. 5, Apr. 5, 1996, pp. 271-273.
European Patent Office Extended Search Report, Application No. 17175267.8-1927, dated Oct. 19, 2017, pp. 1-8.
Extended European Search Report for Application No. 18189791.9 dated Feb. 18, 2019, pp. 1-8.
Gauthier, Gildas P. et al., "A 94-GHz Aperture-Coupled Micromachined Microstrip Antenna," IEEE Transactions on Antennas and Propagation, vol. 47, No. 12, Dec. 1999, pp. 1761-1766.
Grabherr, W. et al., "Microstrip to Waveguide Transition Compatible With mm-Wave Integrated Circuits," IEEE Transactions on Microwave Theory and Techniques, vol. 42, No. 9, Sep. 1994, pp. 1842-1843.
Iizuka, Hideo et al., "Millimeter-Wave Microstrip Line to Waveguide Transition Fabricated on a Single Layer Dielectric Substrate," R&D Review of Toyota CRDL, vol. 37, No. 2, Jun. 2002, pp. 13-18.
Iwasaki, H. "A circularly polarized small-size microstrip antenna with a cross slot," IEEE Transactions on Antennas and Propagation, Oct. 1996.
Jackson D.R. et al., "Leaky-wave antennas," Proceedings of the IEEE, Jul. 2012.
Jain, Sidharath et al., "Flat-Base Broadband Multibeam Luneburg Lens for Wide Angle Scan," Cornell University, May 4, 2013, arXiv.org > physics > arXiv:1305.0964.
Kaneda, Noriaki et al., "A Broad-band Microstrip-to-Waveguide Transition Using Quasi-Yagi Antenna," IEEE Transactions on Microwave Theory and Techniques, Dec. 1999, pp. 1-4.
Kim, D.H. et al., "Radiation of a leaky coaxial cable with narrow traverse slots," IEEE Transactions on Antennas and Propagation, Jan. 2007, pp. 107-110.
Li, B. et al., "Study on High Gain Circular Waveguide Array Antenna with Metamaterial Structure," Progress in Electromagnetics Research (PIER), vol. 6, 2006, pp. 207-219.
Lin, Ting-Huei et al., "CPW to Waveguide Transition with Tapered Slotline Probe," IEEE Microwave and Wireless Components Letters, vol. 11, No. 7, Jul. 2001, pp. 314-316.
Menzel, W. et al., "A microstrip patch antenna with coplanar feed line," IEEE Microwave and Guided Wave Letters, Nov. 1991.

(56) References Cited

OTHER PUBLICATIONS

Papapolymerou, Ioannis et al., "Micromachined Patch Antennas," IEEE Transactions on Antennas and Propagation, vol. 46, No. 2, Feb. 1998, pp. 275-283.
Ponchak, George E. et al., "A New Rectangular Waveguide to Coplanar Waveguide Transition," IEEE MTT-S International Microwave Symposium, May 1990, 4 pgs.
Rida, Amin et al., "Proximity Coupled Fed Antenna Arrays on LCP for mm-Wave Applications," IEEE Antennas and Propagation Society International Symposium, Jul. 2010, 4 pgs.
Satoshi, Y. et al., "Inclined slot array antennas on a rectangular coaxial line," Proceedings of the 5th European Conference on Antennas and Propagation, 2011.
Schoenlinner, Bernhard, "Compact Wide Scan-Angle Antennas for Automotive Applications and RF MEMS Switchable Frequency-Selective Surfaces," A dissertation submitted in partial fulfillment of the requirements for the degree of Doctor of Philosophy, The University of Michigan, 2004, 72 pgs.
Schoenlinner, Bernhard, "Wide-Scan Spherical-Lens Antennas for Automotive Radars," IEEE Transactions on Microwave theory and Techniquest, vol. 50, No. 9, Sep. 2002, pp. 2166-2175.
Simon, W. et al., "A Novel Coplanar Transmission Line to Rectangular Waveguide Transition," IEEE MTT-S Digest, Jun. 1998, pp. 257-260.
Sorkherizi, Milad S. et al., "Planar High-efficiency Antenna Array Using New Printed Ridge Gap Waveguide Technology," IEEE Transactions on Antennas and Propogation, vol. 65, No. 7, Jul. 2017, pp. 3772-3776.
Targonski, S.D. et al., "Design of wideband circularly polarized aperture-coupled microstrip antennas," IEEE Transactions on Antennas and Propagation, Feb. 1993.
Tribe, J. et al., "Additively manufactured hetrogeneous substrates for three-dimensional control of permittivity," Electronics Letters, May 8, 2014, vol. 50, No. 10, pp. 745-746.
Wang, C. et al., "A novel CP patch antenna with a single feed structure," IEEE Antennas and Propagation Society International Symposium, Jul. 2000.
Wang, J. et al., "Multifunctional aperture coupled stack patch antenna," Electronics Letters, Dec. 1990.
Zhang, Guo-Hua et al. "A Circular Waveguide Antenna Using High-Impedance Ground Plane," IEEE Antennas and Wireless Propagation Letters, vol. 2, 2003, pp. 86-88.
Zhang, S. et al. "3D-printed flat lens for microwave applications," presented at the Antennas and Propagation Conference (LAPC2015) Loughborough University, 4 pgs.
Zurcher, J.F. "The SSFIP: a global concept for high-performance broadband patch antennas," Electronics Letters, Nov. 1988.
D.M. Pozar et al., "Increasing the Bandwidth of a Microstrip Antenna by Proximity Coupling", Electronics Letters Apr. 9, 1987 vol. 23 No. 8, pp. 368-369.
H. F. AbuTarboush, et al., "Bandwidth Enhancement for Microstrip Patch Antenna Using Stacked Patch and Slot", 2009 IEEE International Workshop on Antenna Technology, Mar. 2-4, 2009, 4 pgs.
P. A. Ambresh, et al., "Effect of Slots on Microstrip Patch Antenna Characteristics", International Conference on Computer, Communication and Electrical Technology—ICCCET2011, Mar. 18 & 19, 2011, pp. 239-241.

* cited by examiner

LOW-PROFILE CONFORMAL ANTENNA

BACKGROUND

1. Field

The present disclosure is related to antennas, and more specifically, to patch antennas.

2. Related Art

At present, there is a need for antennas that can conform to non-planar, curved surfaces such as aircraft fuselages and wings, ships, land vehicles, buildings, or cellular base stations. Furthermore, conformal antennas reduce radar cross section, aerodynamic drag, are low-profile, and have minimal visual intrusion.

Existing phased array antennas generally include a plurality of antenna elements such as, for example, dipole or patch antennas integrated with electronics that may control the phase and/or magnitude of each antenna element. These phased array antennas are typically complex, expensive, and may be integrated into the surface of an object to which they are designed to operate on. Furthermore, existing phased arrays are generally susceptible to the electromagnetic effects caused by the surfaces on which they are placed, especially if the surfaces are composed of metal (e.g., aluminum, steel, titanium, etc.) or carbon fiber, which is electrically conductive by nature. As such, to compensate for these effects the phased arrays need to be designed taking into account the shape and material of a surface on which they will be placed and, as such, are not flexible for use across multiple types of surfaces, platforms, or uses.

Existing antennas typically have a trade-off between the thickness of the antenna and the bandwidth. A thin antenna, for example, is more flexible, but has a narrower bandwidth. As such, there is a need for a new conformal antenna that addresses these issues.

SUMMARY

Disclosed is a low-profile conformal antenna ("LPCA"). The LPCA includes a plurality of dielectric layers forming a dielectric structure. The plurality of dielectric layers includes a top dielectric layer that includes a top surface. The LPCA further includes an inner conductor, a patch antenna element ("PAE"), and an antenna slot. The inner conductor is formed within the dielectric structure, the PAE is formed on the top surface of the top dielectric layer, and the antenna slot is formed within the PAE. The LPCA is configured to support a transverse electromagnetic ("TEM") signal within the dielectric structure. The LPCA also includes a bottom conductive layer located below the dielectric structure.

Also disclosed is a method for fabricating the LPCA utilizing a lamination process. The method includes: patterning a first conductive layer on a bottom surface of a first dielectric layer having a top surface and the bottom surface to produce a ground plane; patterning a second conductive layer on a top surface of a second dielectric layer having the top surface and a bottom surface to produce an inner conductor; and laminating the bottom surface of the second dielectric layer to the top surface of the first dielectric layer. Furthermore, the method also includes: patterning a third conductive layer on a top surface of a third dielectric layer having the top surface and a bottom surface to produce the PAE with an antenna slot, laminating a bottom surface of a third dielectric layer to a top surface of a fourth dielectric layer, where the fourth dielectric layer has a bottom surface; and laminating the bottom surface of the fourth dielectric layer to the top surface of the second dielectric layer to produce a composite laminated structure.

Further disclosed is a method for fabricating the LPCA utilizing a three-dimensional ("3-D") additive printing process. The method includes: printing a first conductive layer having a top surface and a first width, where the first width has a first center; printing a first dielectric layer on the top surface of the first conductive layer, where the first dielectric layer has a top surface; printing a second dielectric layer on the top surface of the first dielectric layer, where the second dielectric layer has a top surface; and printing a second conductive layer on the top surface of the second dielectric layer. The second conductive layer has a top surface and a second width and the second width is less than the first width. The method further includes: printing a third dielectric layer on the top surface of the second conductive layer and on the top surface on the second dielectric layer, where the third dielectric layer has a top surface; printing a fourth dielectric layer on the top surface of the third dielectric layer, where the fourth dielectric layer has a top surface; and printing a third conductive layer on the top surface of the fourth dielectric layer to produce the PAE. The third conductive layer has a top surface and a third width, the third width is less than the first width, and wherein the third conductive layer includes an antenna slot within the third conductive layer that exposes the top surface of the fourth dielectric layer through the third conductive layer.

Other devices, apparatus, systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
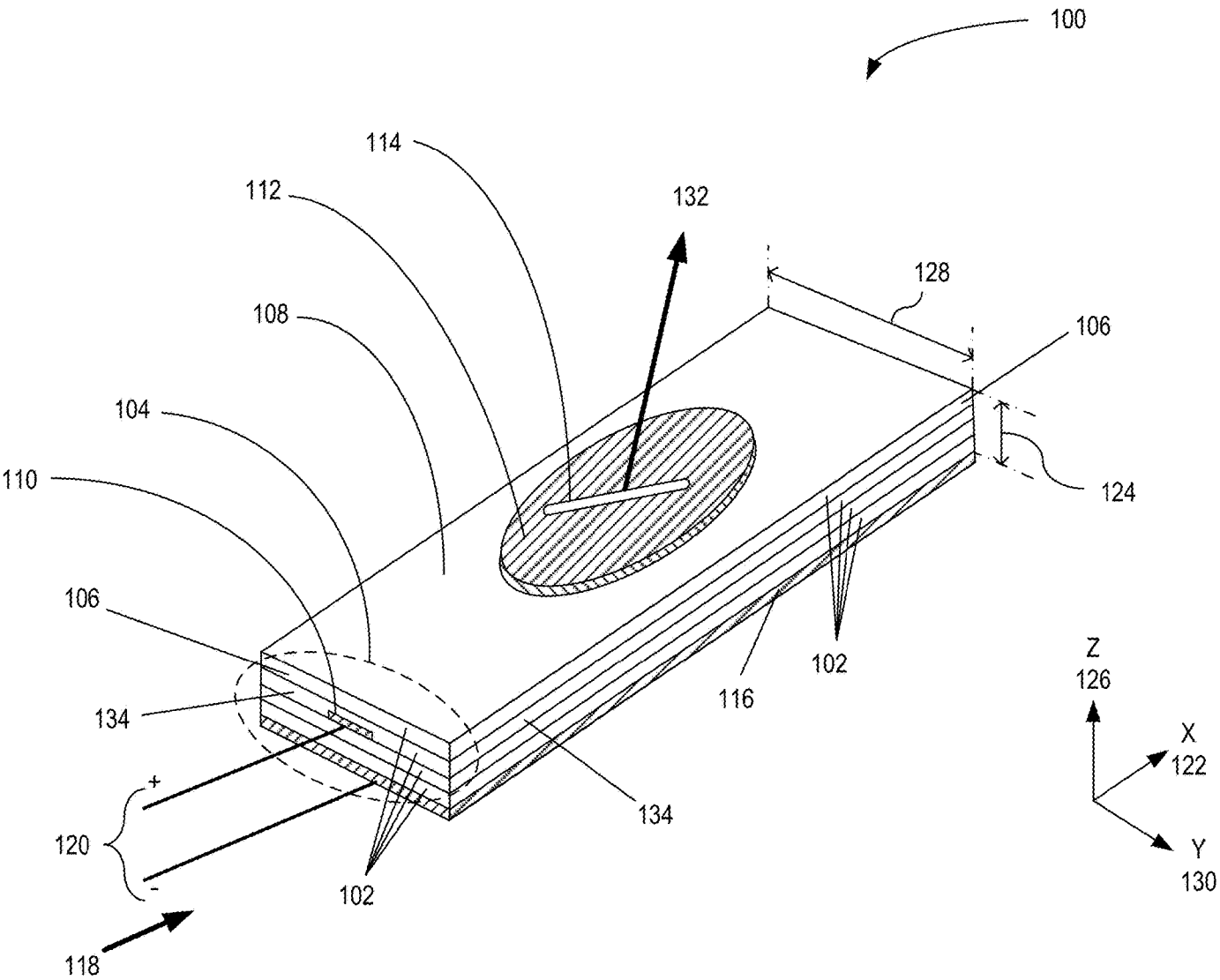
FIG. 1 is a perspective view of an example of an implementation of a low-profile conformal antenna ("LPCA") in accordance with the present disclosure.

A low-profile conformal antenna ("LPCA") is disclosed. The LPCA includes a plurality of dielectric layers forming a dielectric structure. The plurality of dielectric layers includes a top dielectric layer that includes a top surface. The LPCA further includes an inner conductor, a patch antenna element ("PAE"), and an antenna slot. The inner conductor is formed within the dielectric structure, the PAE is formed on the top surface of the top dielectric layer, and the antenna slot is formed within the PAE. The LPCA is configured to support a transverse electromagnetic ("TEM") signal within the dielectric structure. The LPCA also includes a bottom conductive layer located below the dielectric structure.

Also disclosed is a method for fabricating the LPCA utilizing a lamination process. The method includes: patterning a first conductive layer on a bottom surface of a first dielectric layer having a top surface and the bottom surface to produce a ground plane; patterning a second conductive layer on a top surface of a second dielectric layer having the top surface and a bottom surface to produce an inner conductor; and laminating the bottom surface of the second dielectric layer to the top surface of the first dielectric layer. Furthermore, the method also includes: patterning a third conductive layer on a top surface of a third dielectric layer having the top surface and a bottom surface to produce the PAE with an antenna slot, laminating a bottom surface of a third dielectric layer to a top surface of a fourth dielectric layer, where the fourth dielectric layer has a bottom surface; and laminating the bottom surface of the fourth dielectric layer to the top surface of the second dielectric layer to produce a composite laminated structure.

Further disclosed is a method for fabricating the LPCA utilizing a three-dimensional ("3-D") additive printing process. The method includes: printing a first conductive layer having a top surface and a first width, where the first width has a first center; printing a first dielectric layer on the top surface of the first conductive layer, where the first dielectric layer has a top surface; printing a second dielectric layer on the top surface of the first dielectric layer, where the second dielectric layer has a top surface; and printing a second conductive layer on the top surface of the second dielectric layer. The second conductive layer has a top surface and a second width, and the second width is less than the first width. The method further includes: printing a third dielectric layer on the top surface of the second conductive layer and on the top surface on the second dielectric layer, where the third dielectric layer has a top surface; printing a fourth dielectric layer on the top surface of the third dielectric layer, where the fourth dielectric layer has a top surface; and printing a third conductive layer on the top surface of the fourth dielectric layer to produce the PAE. The third conductive layer has a top surface and a third width, the third width is less than the first width, and wherein the third conductive layer includes an antenna slot within the third conductive layer that exposes the top surface of the fourth dielectric layer through the third conductive layer.

In general, the LPCA disclosed utilizes an embedded radio frequency ("RF") microstrip for efficient signal propagation and simplification of planar arraying and thin RF dielectrics for conformal applications. Additionally, the LPCA may be surface agnostic (i.e., the electrical performance of the LPCA is not dependent on the surface type on which the LPCA is placed) and may be circularly polarized utilizing an inclusive slot in one or more PAE antenna elements to minimize polarization losses due to misalignment and increase the bandwidth.

In this example, the RF microstrip is an aperture coupled antenna feed that is located below one or more PAE antenna elements and is configured to couple energy to one or more PAE antenna elements. The width of the antenna feed (i.e., RF microstrip) and the position below the one or more PAE antenna elements are predetermined to match the impedance between the antenna feed and one or more PAE antenna elements. Additionally, each PAE antenna element includes an inclusive slot with a predetermined slot length to increase the bandwidth of the antenna, a predetermined angle to provide circular polarization for the antenna, and a predetermined slot width to match the impedance between the antenna feed and the corresponding PAE antenna element.

Moreover, the LPCA may be fabricated utilizing either a combination of successive subtractive (e.g., wet etching, milling, or laser etching) and additive (e.g., 3-D additive printing, thin-film deposition) techniques or exclusively utilizing additive printing. In this disclosure, the bandwidth of the antenna is increased by utilizing combination of an aperture coupled antenna feed with a slot element in the PAE antenna element and/or ground plane. In addition to increasing the bandwidth of the antenna, the slot element also decreases the axial ratio (i.e., enhances circular polarization). Furthermore, since the LPCA includes a bottom layer that is a conductor located below the dielectric structure, the bottom layer is a low-impedance ground plane that minimizes any electrical effects of any surface to which the LPCA may be placed thus rendering the LPCA as surface agnostic.

More specifically, in FIG. 1, a perspective view of an example of an implementation of the LPCA 100 is shown in accordance with the present disclosure. The LPCA 100 includes a plurality of dielectric layers 102 forming a dielectric structure 104. The plurality of dielectric layers 102 includes a top dielectric layer 106 that includes a top surface 108. The LPCA 100 further includes an inner conductor 110, a PAE 112, and an antenna slot 114. The inner conductor 110 is formed within the dielectric structure 104, the PAE 112 is formed on the top surface 108 of the top dielectric layer 106, and the antenna slot 114 is formed within the PAE 112. Moreover, the LPCA 100 also includes a bottom layer 116 that is a conductor and is located below the dielectric structure 104. In this example, the top surface 108 of the top dielectric layer 106 is also the top surface of the dielectric structure 106. Moreover, the PAE 112 is also a conductor. The antenna slot 114 is angled cut along the PAE 112 is angled with respect to the inner conductor 110. The antenna slot 114 allows the top surface 108 to be exposed through the PAE 112. The LPCA 100 is configured to radiate a TEM input signal 118 that is injected into an input port 120 of the LPCA 100 in a direction along an X-axis 122. In this example, the input port 120 is shown in signal communication with both the inner conductor 110 and the bottom layer 116, where the inner conductor 110 has a first polarity (e.g., positive) with respect to the bottom layer 116 with an opposite polarity (e.g., negative). However, it is appreciated by those of ordinary skill in the art that the polarities alternate in time for electromagnetic signals. In this example, the inner conductor 110, PAE 112, and bottom layer 116 may be metal conductors. The bottom layer 116, for example, may be constructed of electroplated copper, while the inner conductor 110 and PAE 112 may be constructed of printed silver ink.

It is appreciated by those of ordinary skill in the art that the circuits, components, modules, and/or devices of, or associated with, the LPCA 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

In this example, each dielectric layer, of the plurality of dielectric layers 102, may be an RF dielectric material and the inner conductor 110 may be a RF microstrip or stripline conductor. The inner conductor 110 may be located at a predetermined center position within the dielectric structure 104. In this example, the center position is equal to approximately half of a stack-up height 124 along a Z-axis 126. Moreover, the inner conductor 110 may also have an inner conductor center that is located at a second position within the dielectric structure 104 that is approximately at a second center position that is equal to approximately half of a width 128 of the dielectric structure 106 along a Y-axis 130.

Alternatively, the dielectric structure 104 may be constructed utilizing a three-dimensional ("3-D") additive printing process. In this example, each dielectric layer (of the dielectric structure 104) may be constructed by printing (or "patterning") successively printing dielectric layers and printing conductive layers. In these examples, each dielectric layer (of the dielectric structure 104) may have a thickness that is approximately equal 10 mils. The bottom layer 116, inner conductor 110, and PAE 112 may have a thickness that is, for example, approximately equal to 0.7 mils (i.e., about 18 micrometers).

In this example, the input TEM signal 118 propagates along the length of the LPCA 100 (along the X-axis 122) towards the PAE 112 with the antenna slot 114 where electromagnetic coupling occurs between the inner conductor 110 and PAE 112 with the antenna slot 114 to produce a radiated signal 132 that is emitted from the PAE 112 with the antenna slot 114. It is appreciated by those of ordinary skill in the art that the electromagnetic characteristics of the radiated signal 132 are determined by the geometry (or shape) dimensions (e.g., radius, thickness), and position of the PAE 112 along the top surface 108 and the geometry and dimensions of the antenna slot 114 within the PAE 112. In this example, the inner conductor 110 is shown to be located within a middle dielectric layer 134.

Figure 2:
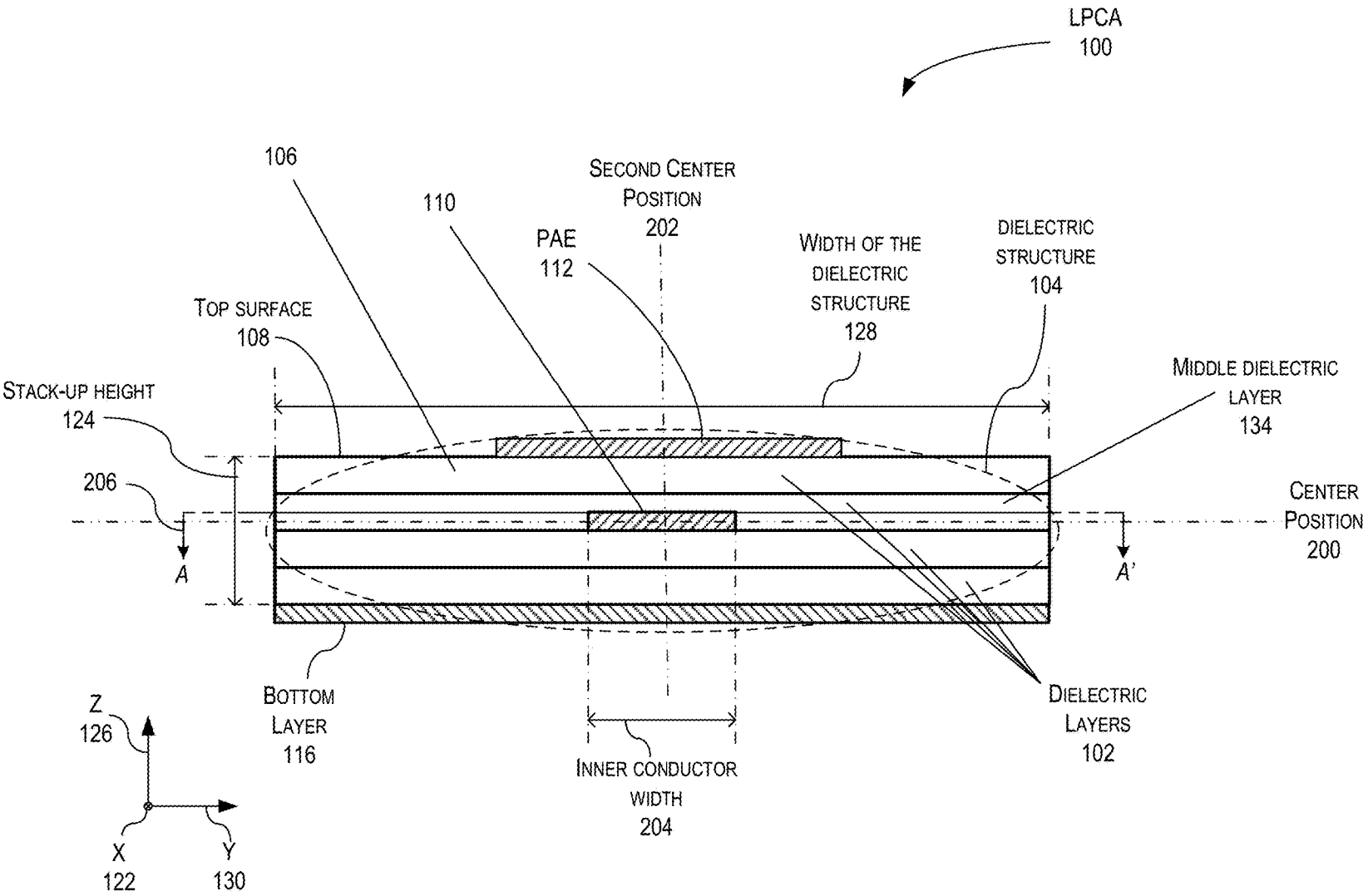
FIG. 2 is a cross-sectional view of the LPCA (shown in FIG. 1) in accordance with the present disclosure.

In FIG. 2, a cross-sectional view of the LPCA 100 is shown in accordance with the present disclosure. In this view, the plurality of dielectric layers 102, top dielectric layer 106, dielectric structure 104, inner conductor 110, top surface 108, bottom layer 116, and the PAE 112 are shown. In this example, each of the dielectric layers of the plurality of dielectric layers 102 are RF dielectrics.

The center position 200 that may be equal to approximately half of the stack-up height 124 and the second center position 202 that is equal to approximately half of the width 128 of the dielectric structure 104 are also shown. It is appreciated by those of ordinary skill in the art that while only four (4) dielectric layers are shown in the plurality of dielectric layers 104, any number greater than two (2) may be utilized for the number of dielectric layers of the plurality of dielectric layers 104. The inner conductor 110 is also shown to have a width 204 that is approximately centered about the second center position 202. In this example, the inner conductor 110 is an RF microstrip or stripline located below the PAE 112 acting as an aperture coupled antenna feed configured to couple energy from the input TEM signal 118 to the PAE 112. In general, the width 204 of the inner conductor 110 and the position below (i.e., the center position 200) the PAE 112 are predetermined by the design of the LPCA 100 to approximately match the impedance between the inner conductor 110 and the PAE 112 with the antenna slot 114. As such, while the center position 200 is shown in FIG. 2 to be approximately in the center of the stack-up height 124, it is appreciated by those of ordinary skill in the art that this is an approximation that may vary because the actual center position 200 is predetermined from the design of the LPCA 100. However, for purposes of illustration, the predetermined position is assumed to be generally close to the center position of the stack-up height, but it is appreciated that this may vary based on the actual design of the LPCA 100. Additionally, while not shown in this view, the antenna slot 114 is within the PAE 112 and increases the bandwidth of the PAE 112 and also has a predetermined angle with respect to the inner conductor 110 to provide circular polarization from the PAE 112 and a predetermined slot width to match the impedance between the inner conductor 110 and the PAE 112.

In an example of operation, the input TEM signal 118 travels in the X-axis 122 from the input port 120 to the PAE 112 between the inner conductor 110 and bottom layer 116. The electromagnetic fields at the end of the inner conductor 110 couples to the PAE 112 with the antenna slot 114. The PAE 112 with the antenna slot 114 then radiates a signal 132 through free-space.

Figure 3:
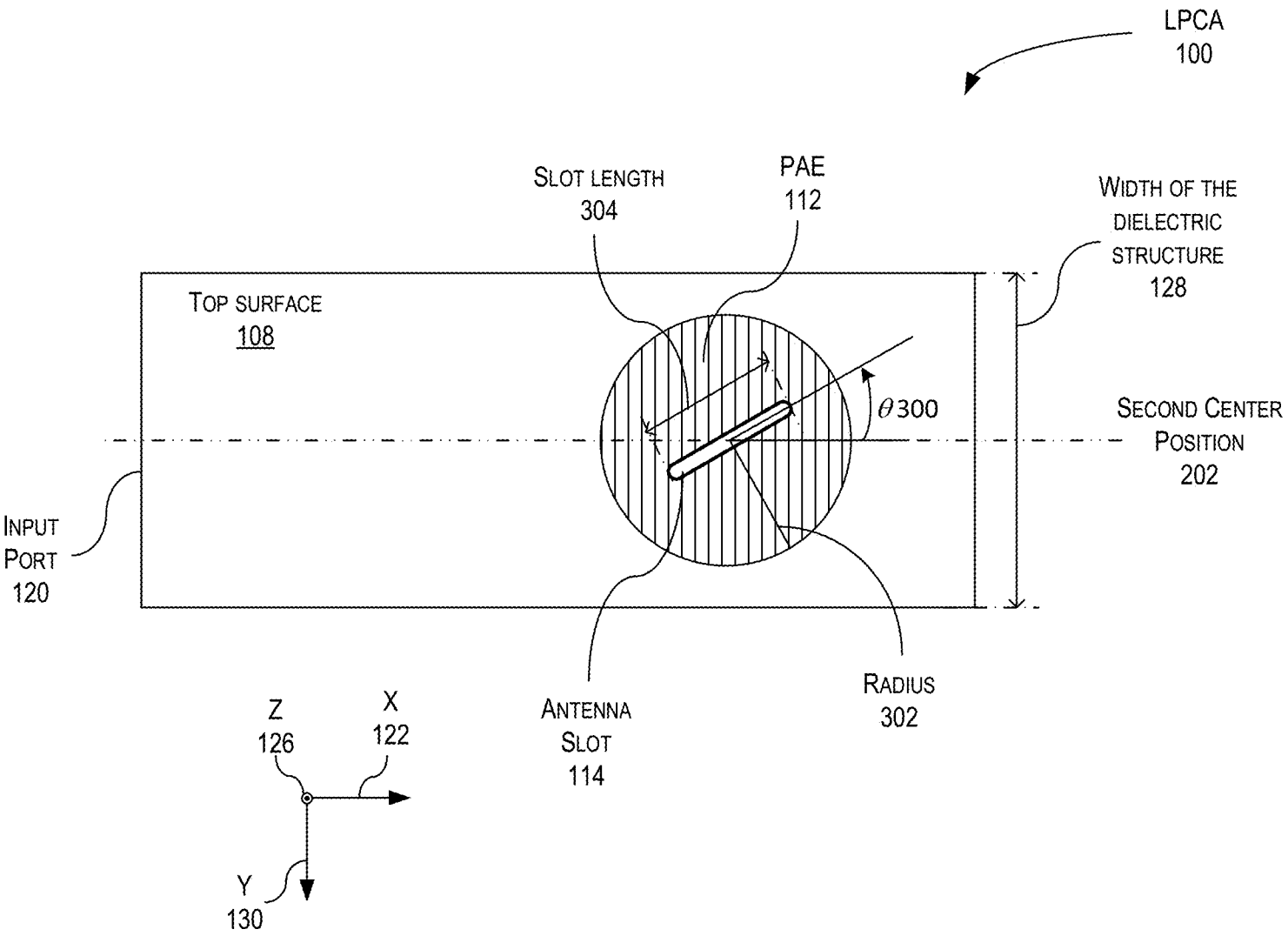
FIG. 3 is a top view of the LPCA (shown in FIGS. 1 and 2) in accordance with the present disclosure.

In FIG. 3, a top view of the LPCA 100 (shown in FIGS. 1 and 2) is shown in accordance with the present disclosure. In this example, the antenna slot 114 is shown within the PAE 112 at an angle θ 300 with respect to the inner conductor 110. In this example, the antenna slot 114 is shown to be centered about the second center position 202. In this example, the PAE 112 is shown to have a circular shape with a radius 302. As discussed earlier, the geometry (or shape), dimensions (radius and thickness), and position of the PAE 112 along the top surface 108 and the geometry and dimensions of the antenna slot 114 within the PAE 112 determine the electromagnetic characteristics of the radiated signal 132. Moreover, in this example, the PAE 112 is circular and has the radius 302 and the antenna slot 114 has a slot length 304. In general, the radius 302 of the PAE 112 and the slot length 304 are predetermined to optimize/maximize the radiated signal 132 produced by the PAE 112 at a predetermined operating frequency. It is appreciated by those of ordinary skill in the art that other may also be utilized in the present disclosure without departing from the spirit or principles disclosed herein.

Figure 4:
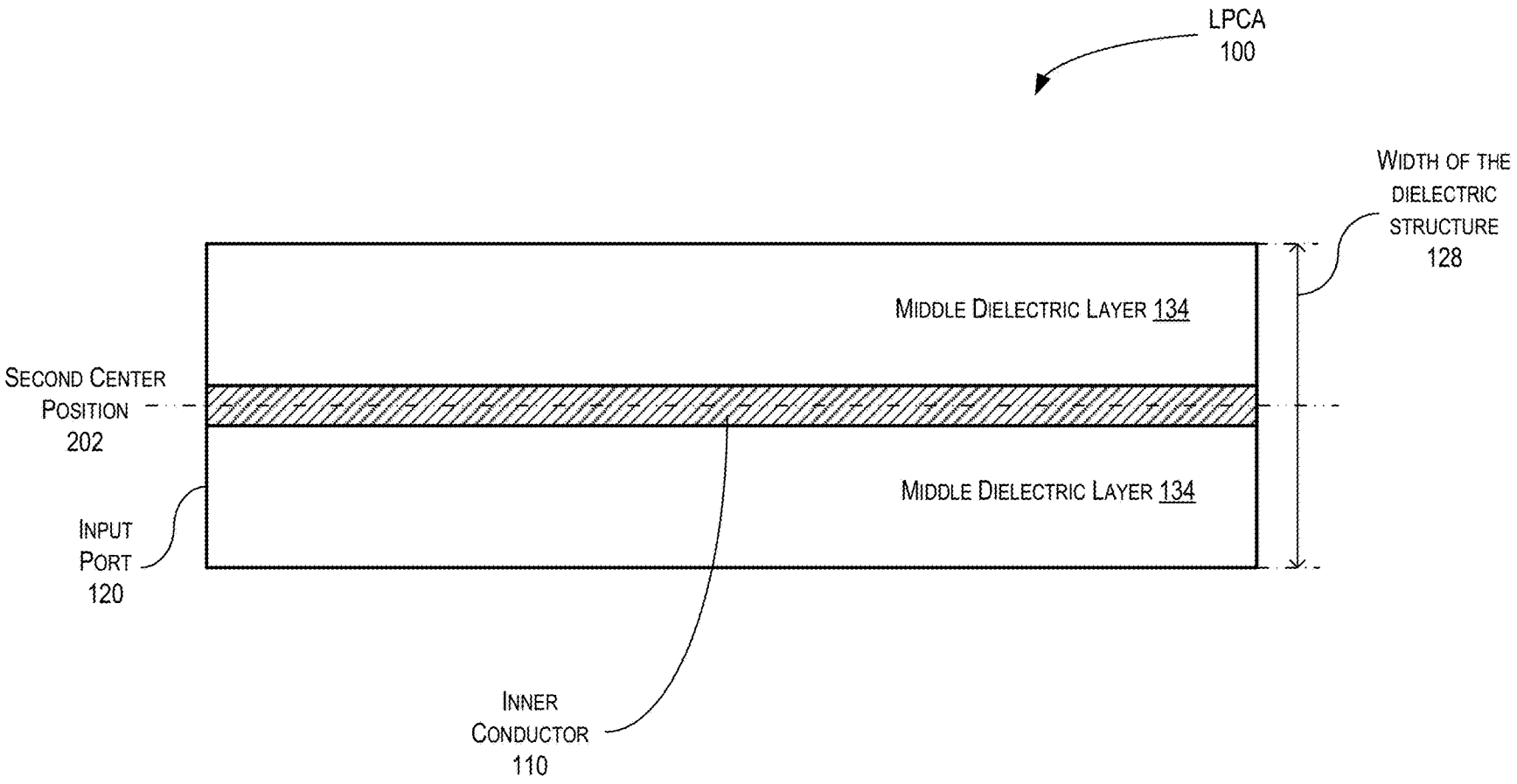
FIG. 4 is a cross-sectional view showing the inner conductor running along a LPCA length in accordance with the present disclosure.

FIG. 4 is a top cut-away cross-sectional view along cutting plane AA' 204 showing the inner conductor 110 running along the LPCA 100 length (in the direction of the X-axis 122) in accordance with the present disclosure. In this example, the inner conductor 110 is shown to be in the middle dielectric layer 134 of the laminated dielectric structure 104 between two other dielectric layers (not shown).

Figure 5:
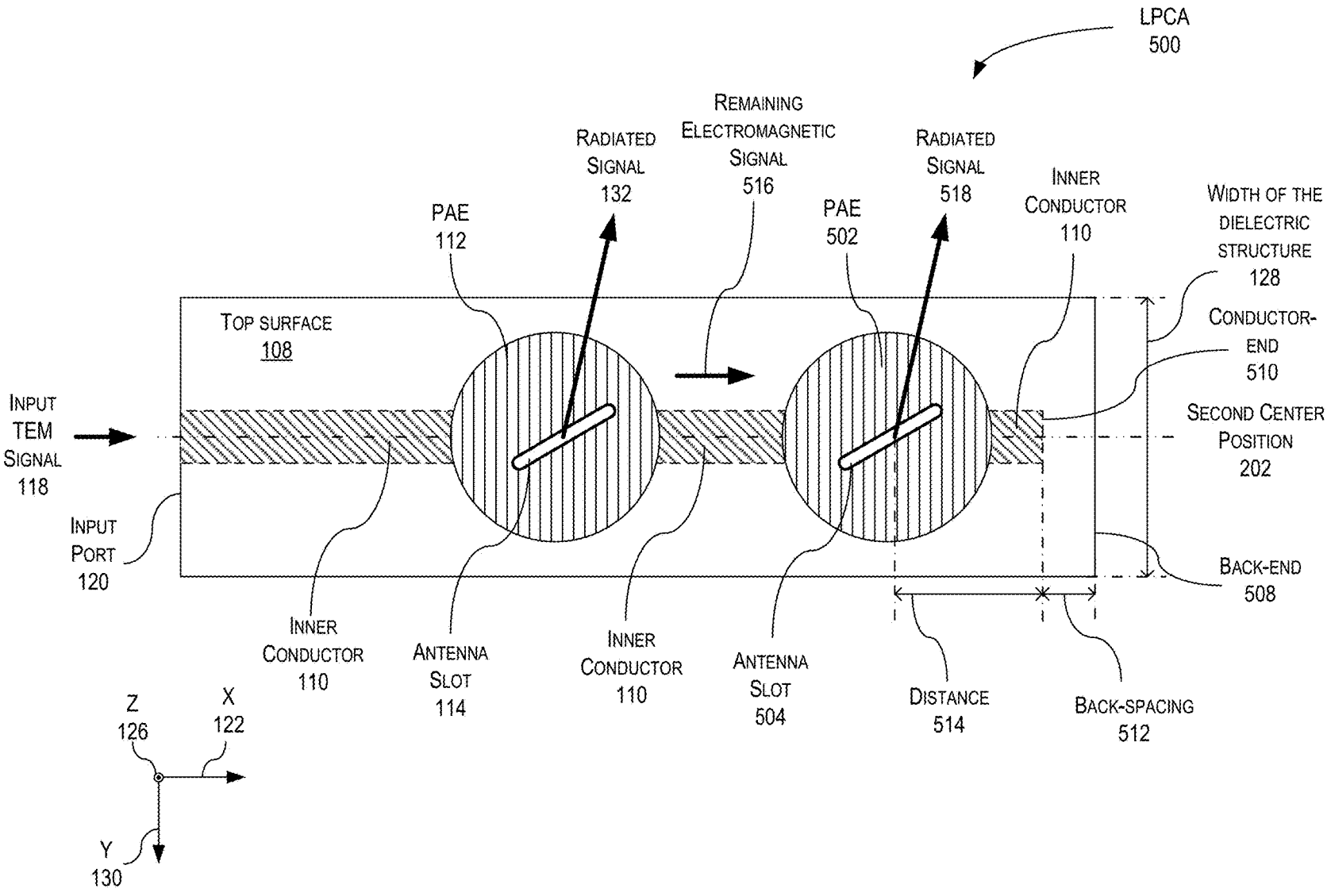
FIG. 5 is a top view of an example of another implementation of the LPCA with antenna elements fed serially in accordance with the present disclosure.

In FIG. 5, a top view of an example of an implementation of the LPCA 500 is shown in accordance with the present disclosure. In this example, the LPCA 500 is a serially fed 2×1 array that includes a second PAE 502 on the top surface 108 with a second antenna slot 504 within the second PAE 502. In this example, the hidden inner conductor 110 is shown through the top surface 108 to illustrate the example location/position of the first PAE 112 with the first antenna slot 114 and the second PAE 502 with the second antenna slot 504 in relation to the position of the inner conductor 110 along the second center position 202. It is appreciated by those of ordinary skill that the LPCA 500 illustrated is not drawn to scale.

In general, the inner conductor 110 extends from the input port 120 along the length of the LPCA 500 to a back-end 508 of the LPCA 500, where the inner conductor 110 has a conductor-end 510 that may optionally extend completely to the back-end 508 or at a back-spacing distance 514 from the back-end 508 that is pre-determined by the design of the LPCA 500 to optimize the electrical performance of the LPCA 500. Moreover, the conductor-end 510 may be positioned within the LPCA 500 at a pre-determined distance 514 from the center of the second PAE to optimize the amount of energy coupled from the microstrip or stripline to the first PAE 112 and second PAE 502.

In an example of operation, the first TEM signal 118 is injected into the input port 120 and propagates along the length of the LPCA 500. When an electromagnetic signal produced by the first TEM signal 118 reaches the first PAE 112 with the first antenna slot 114, a portion of the electromagnetic signal produces a first radiated signal 132. The remaining electromagnetic signal 516 then propagates towards the second PAE 502 with the second antenna slot 504. When the remaining electromagnetic signal 516 reaches the second PAE 502 with the second antenna slot 504 a portion of the electromagnetic signal 516 produces a second radiated signal 518.

Figure 6:
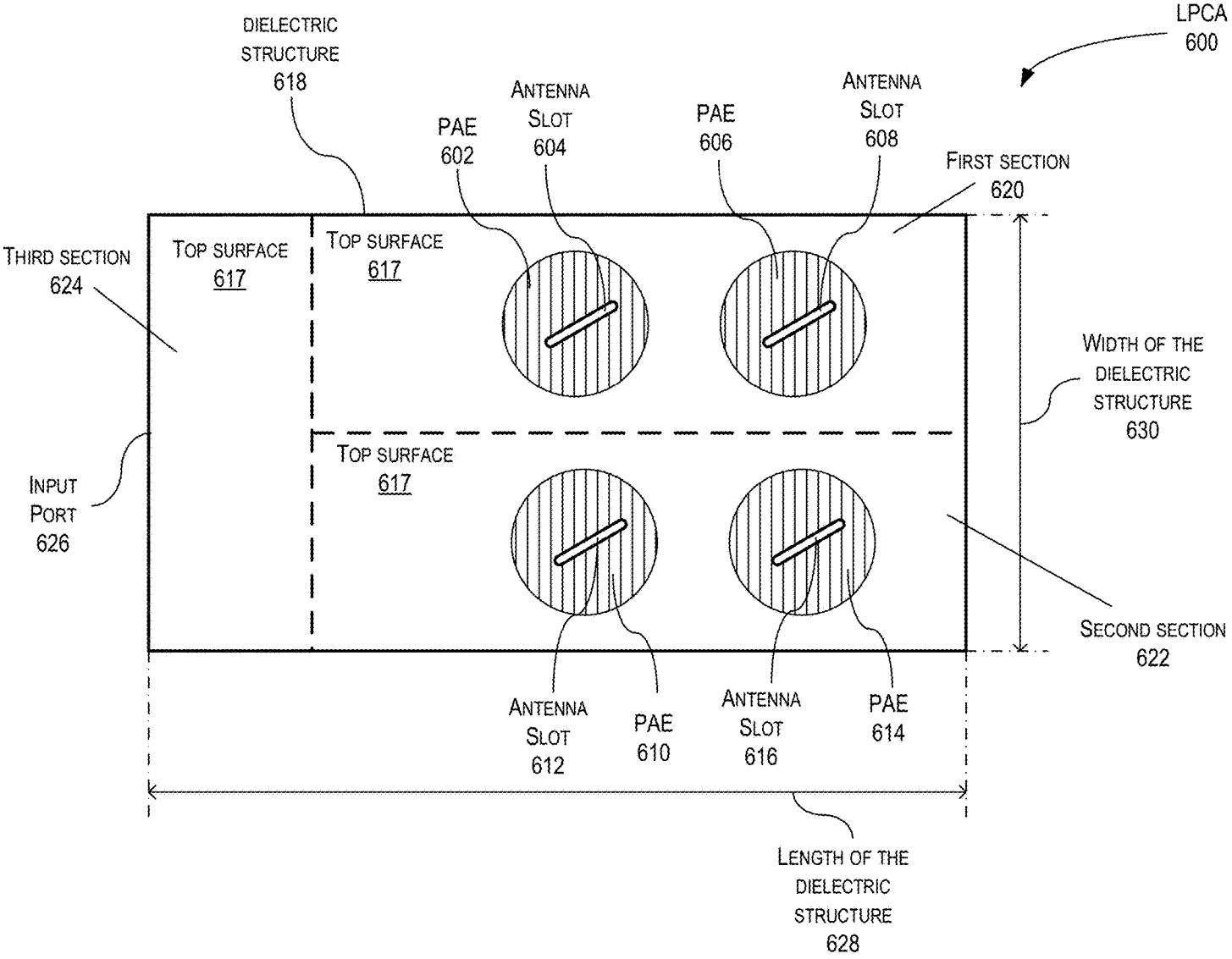
FIG. 6 is a top view of an example of yet another implementation of the LPCA with antenna elements fed in a serial and parallel combination in accordance with the present disclosure.

In FIG. 6, a top view of an example of yet another implementation of the LPCA 600 is shown in accordance with the present disclosure. In this example, the LPCA 600 is a parallel and serially fed combination 2×2 array that includes a first PAE 602 with a first antenna slot 604, a second PAE 606 with a second antenna slot 608, a third PAE 610 with a third antenna slot 612, and a fourth PAE 614 with a fourth antenna slot 616. In this example, as described earlier, the first PAE 602, second PAE 606, third PAE 610, and fourth PAE 614 are located on the top surface 617 of the top dielectric layer of the dielectric structure 618. Additionally, the first antenna slot 604 is located within the first PAE 602, the second antenna slot 608 is located within the second PAE 606, the third antenna slot 612 is located within the third PAE 610, and the fourth antenna slot 616 is located within the fourth PAE 614. Moreover, in this example, the top surface 617 is shown divided into three sections that include a first section 620, second section 622, and third section 624. The first PAE 602 with the first antenna slot 604 and the second PAE 606 with the second antenna slot 608 are located within the first section 620 along with a first microstrip or stripline (not shown) that is covered by the top surface 617. The third PAE 610 with the third antenna slot 612 and the fourth PAE 614 with the fourth antenna slot 616 are located within the second section 622 along with a second microstrip or stripline (not shown) that is also covered by the top surface 617. In this example, the first and second microstrips are each composed of an inner conductor and bottom layer (e.g., inner conductor 110 and bottom layer 116 shown in FIGS. 1 and 2). In the third section 624, the LPCA 600 includes a power divider (not shown) that is located in a middle dielectric layer (not shown) and is also covered by the top surface 617. The power divider is electrically connected to an input port 626. In this example, the inner conductors of the first and second microstrips are electrically connected to the power divider and the bottom layer is a conductor that extends the entire length 628 and width 630 of the dielectric structure 618.

Figure 7:
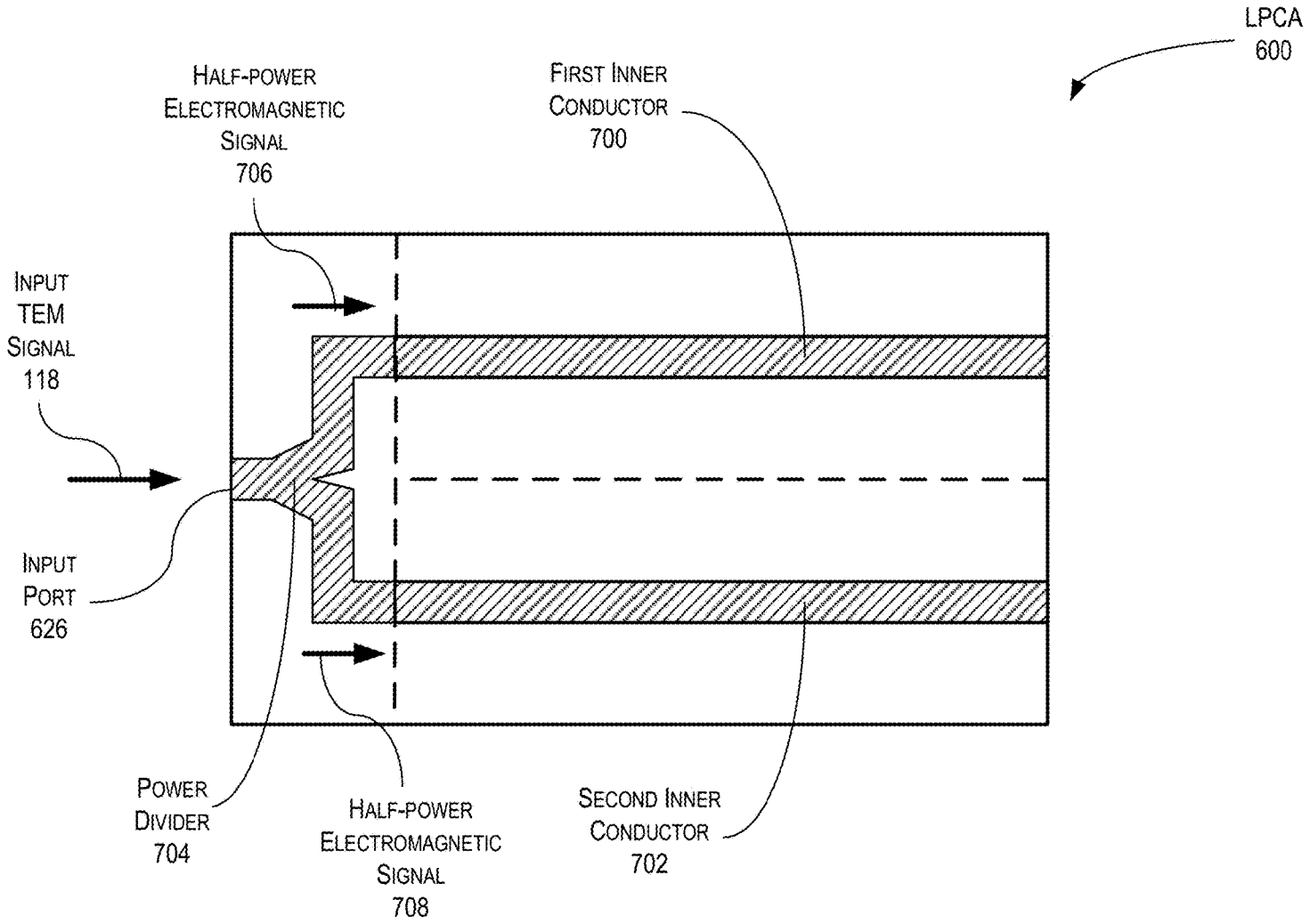
FIG. 7 is a cut-away view of the LPCA (shown in FIG. 6) showing a first inner conductor, a second inner conductor, and a power divider in accordance with the present disclosure.

In FIG. 7, a cut-away view of the LPCA 600 (shown in FIG. 6) showing an example of an implementation of a first inner conductor 700, a second inner conductor 702, and a power divider 704 in accordance with the present disclosure. In this example, the power divider 704 may be a stripline or microstrip type of power divider that divides the input TEM signal 118 at the input port 626 into two equal half-power input electromagnetic signals 706 and 708 that are injected into the first inner conductor 700 and second inner conductor 702, respectively.

Figure 8:
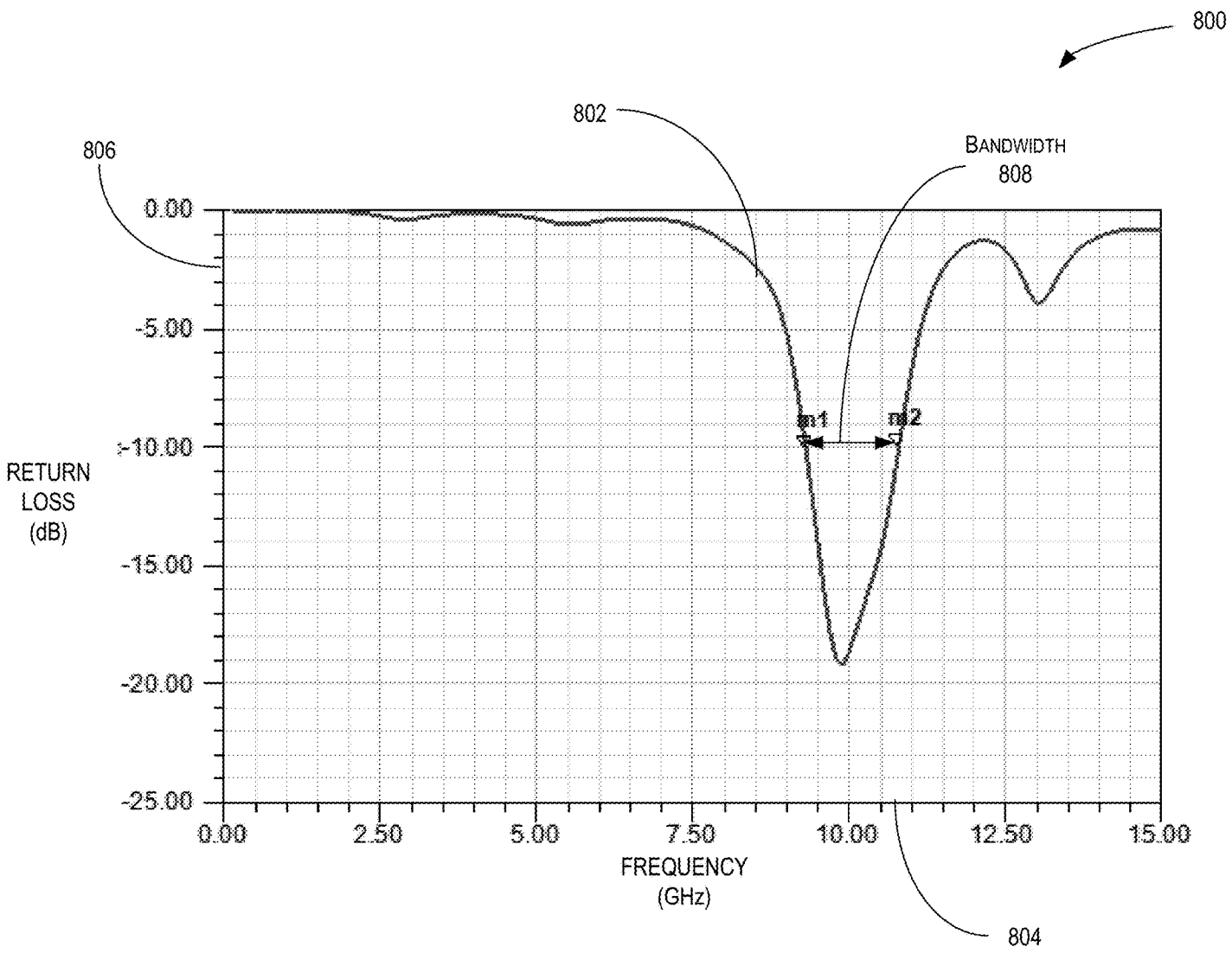
FIG. 8 is a graph of a plot of an example of the predicted return loss performance of the LPCA (shown in FIGS. 6 and 7) as a function of frequency in accordance with the present disclosure.

As an example of operation, in FIG. 8, a graph 800 of a plot 802 is shown of an example return loss performance of the LPCA 600 (shown in FIGS. 6 and 7) as a function of frequency is shown in accordance with the present disclosure. In this example, the horizontal axis 804 represents the frequency in gigahertz ("GHz") and the vertical axis 806 represents the return loss in decibels ("dB"). The horizontal axis 804 varies from 0 to 15 GHz and the vertical axis 806 varies from −25 to 0 dB. In this example, the LPCA 600 is a 2×2 circular patch array designed to operate at 10 GHz with a resulting bandwidth 808 of approximately 1.49 GHz.

Figure 9:
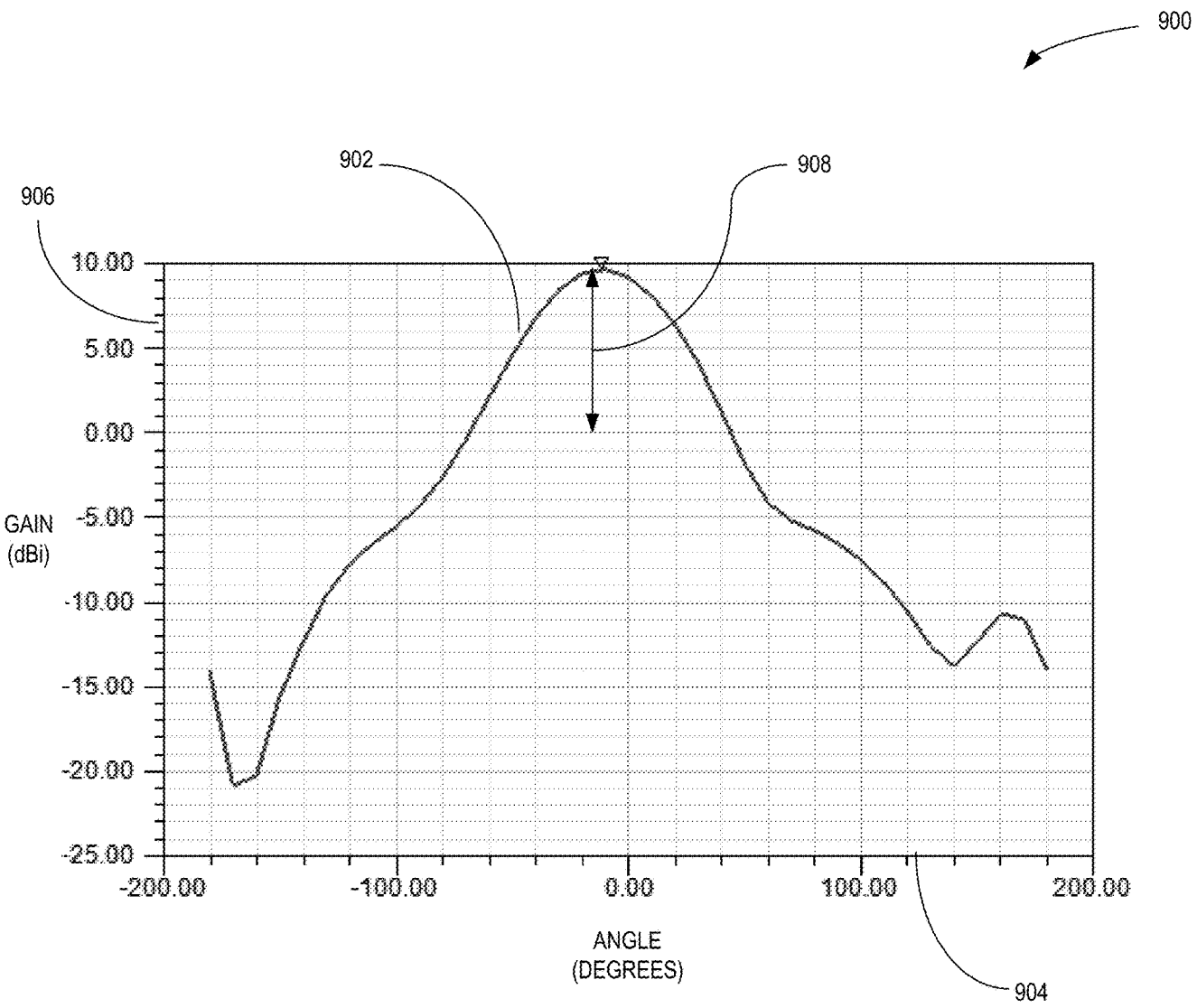
FIG. 9 is a plot of another an example of the predicted gain performance of the LPCA (shown in FIGS. 6 and 7) as a function of elevation angle in accordance with the present disclosure.

In FIG. 9, a graph 900 of a plot 902 is shown of an example gain performance of the LPCA 600 as a function of the elevation angle of the antenna in accordance with the present disclosure. Similar to FIG. 8, in this example, the horizontal axis 904 represents the elevation angle of the antenna in degrees and the vertical axis 906 represents the gain in decibels-isotropic ("dBi"). The horizontal axis 904 varies from −200.00 to 200.00 degrees and the vertical axis 906 varies from −25 to 10 dBi. Again, in this example, the LPCA 600 is a 2×2 circular patch array designed to operate at 10 GHz with a resulting predicted gain 908 of approximately 9.6 dBi.

Turning to FIGS. 10A-10F, a method for fabricating the LPCA (i.e., either LPCA 100, 500, or 600) utilizing a lamination process is shown. Specifically, in FIG. 10A, a cross-sectional view of a first section 1000 of the LPCA is shown in accordance with the present disclosure. The first section 1000 of the LPCA includes a first dielectric layer 1002 with a first conductive layer 1004 patterned on a bottom surface 1008 of the first dielectric layer 1002, where the first dielectric layer 1002 has a top surface 1006 and the bottom surface 1008. In this example, the first conductive layer 1004 is the bottom layer (i.e., bottom layer 116). In this example, the first conductive layer 1004 may be constructed of a conductive metal such as, for example, electroplated copper or printed silver ink.

Figure 10A:
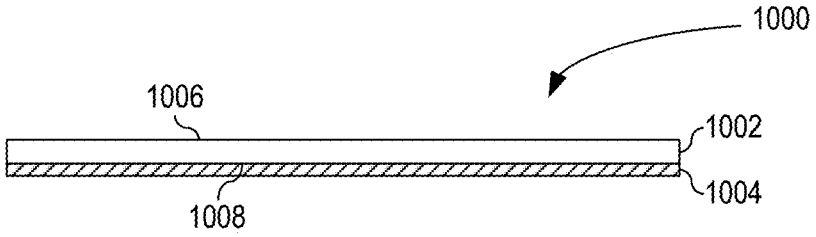
FIG. 10A is a cross-sectional view of a first section of the LPCA (shown in FIGS. 1-7) in accordance with the present disclosure.
Figure 10B:
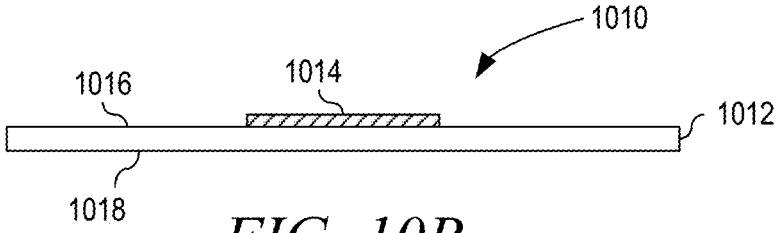
FIG. 10B is a cross-sectional view of a second section of the LPCA in accordance with the present disclosure.

In FIG. 10B, a cross-sectional view of a second section 1010 of the LPCA is shown in accordance with the present disclosure. The second section 1010 of the LPCA includes a second dielectric layer 1012 with a second conductive layer 1014 patterned on a top surface 1016 of the second dielectric layer 1012, where the second dielectric layer 1012 includes the top surface 1016 and a bottom surface 1018. In this example, the second conductive layer 1014 is an inner conductor (i.e., inner conductor 110) of the LPCA. In this example, the second conductive layer 1014 may be constructed of a conductive metal such as, for example, electroplated copper or printed silver ink.

Figure 10C:
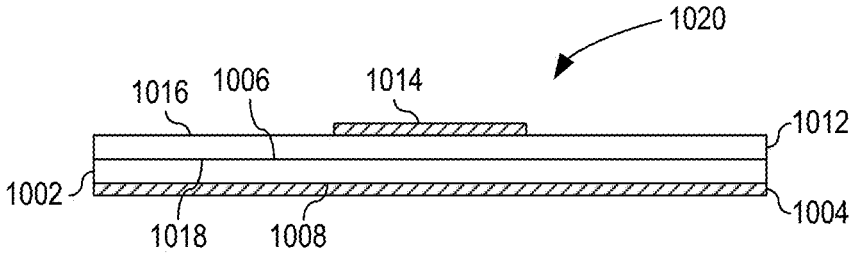
FIG. 10C is a cross-sectional view of a first combination of the first section and the second section of the LPCA in accordance with the present disclosure.

In FIG. 10C, a cross-sectional view of a first combination 1020 of the first section 1000 and the second section 1010 of the LPCA is shown in accordance with the present disclosure. The first combination 1020 is formed by laminating the bottom surface 1018 of the second dielectric layer 1012 to the top surface 1006 of the first dielectric layer 1002.

Figure 10D:
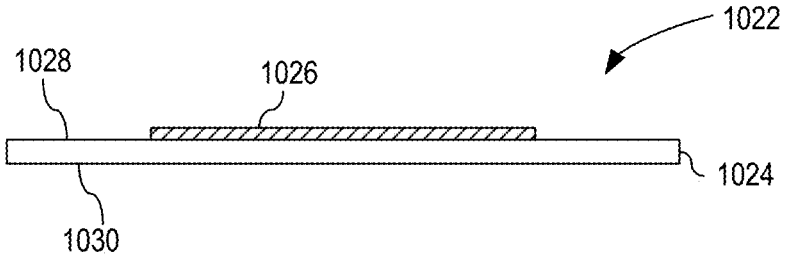
FIG. 10D is a cross-sectional view of a third section of the LPCA in accordance with the present disclosure.

In FIG. 10D, a cross-sectional view of a third section 1022 of the LPCA is shown in accordance with the present disclosure. The third section 1022 of the LPCA includes a third dielectric layer 1024 with a third conductive layer 1026 patterned on a top surface 1028 of the third dielectric layer 1024, where the third dielectric layer 1024 also includes a bottom surface 1030. In this example, the third conductive layer 1024 is the PAE of the LPCA. In this example, the third conductive layer 1026 may be constructed of a conductive metal such as, for example, electroplated copper or printed silver ink.

Figure 10E:
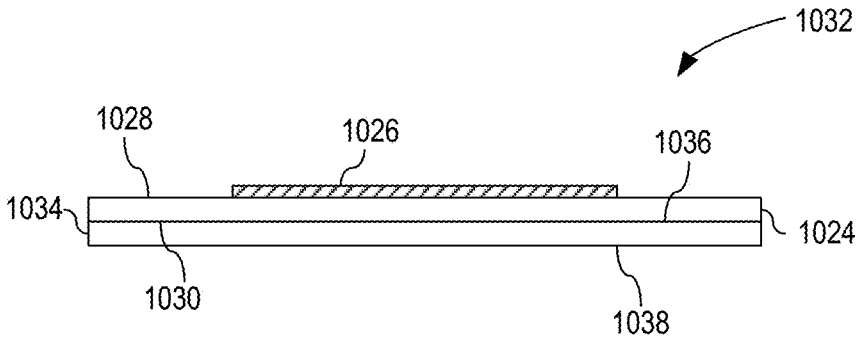
FIG. 10E is a cross-sectional view of a second combination that includes the first combination and a third dielectric layer of the LPCA in accordance with the present disclosure.

In FIG. 10E, a cross-sectional view of a second combination 1032 that includes the third section 1022 and a fourth dielectric layer 1034 of the LPCA is shown in accordance with the present disclosure. The second combination is formed by laminating the bottom surface 1030 of the third dielectric layer 1024 to a top surface 1036 of the fourth dielectric layer 1034, wherein the fourth dielectric layer 1034 also includes a bottom surface 1038. In this example, the fourth dielectric layer 1034 is the middle dielectric layer 134 shown in FIGS. 1 and 2.

Figure 10F:
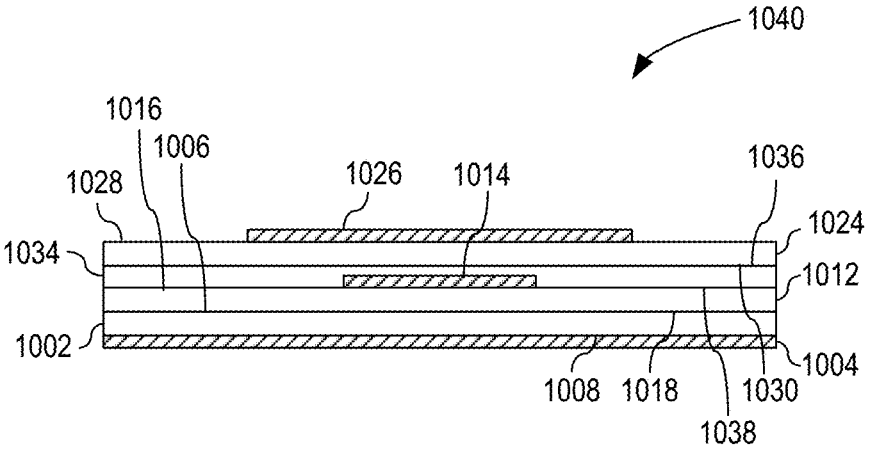
FIG. 10F is a cross-sectional view of a composite laminated structure that includes the first combination and a second combination of the LPCA in accordance with the present disclosure.

In FIG. 10F, a cross-sectional view of a composite laminated structure 1040 that includes the first combination 1020 and second combination 1032 of the LPCA is shown in accordance with the present disclosure. In the composite laminated structure 1040, the bottom surface 1038 of the fourth dielectric layer 1034 is laminated on to the top surface 1016 of the second dielectric layer 1012 producing the composite laminated structure 1040 that is also the dielectric structure (e.g., dielectric structure 104).

In these examples, the first dielectric layer 1004, second dielectric layer 1012, third dielectric layer 1024, and fourth dielectric layer 1034 may be constructed of an RF dielectric material. Moreover, each of these dielectric layers 1004, 1012, 1024, and 1034 may be laminated to each other and the second conductive layer 1014 with an adhesive tape or bonding film.

Figure 11:
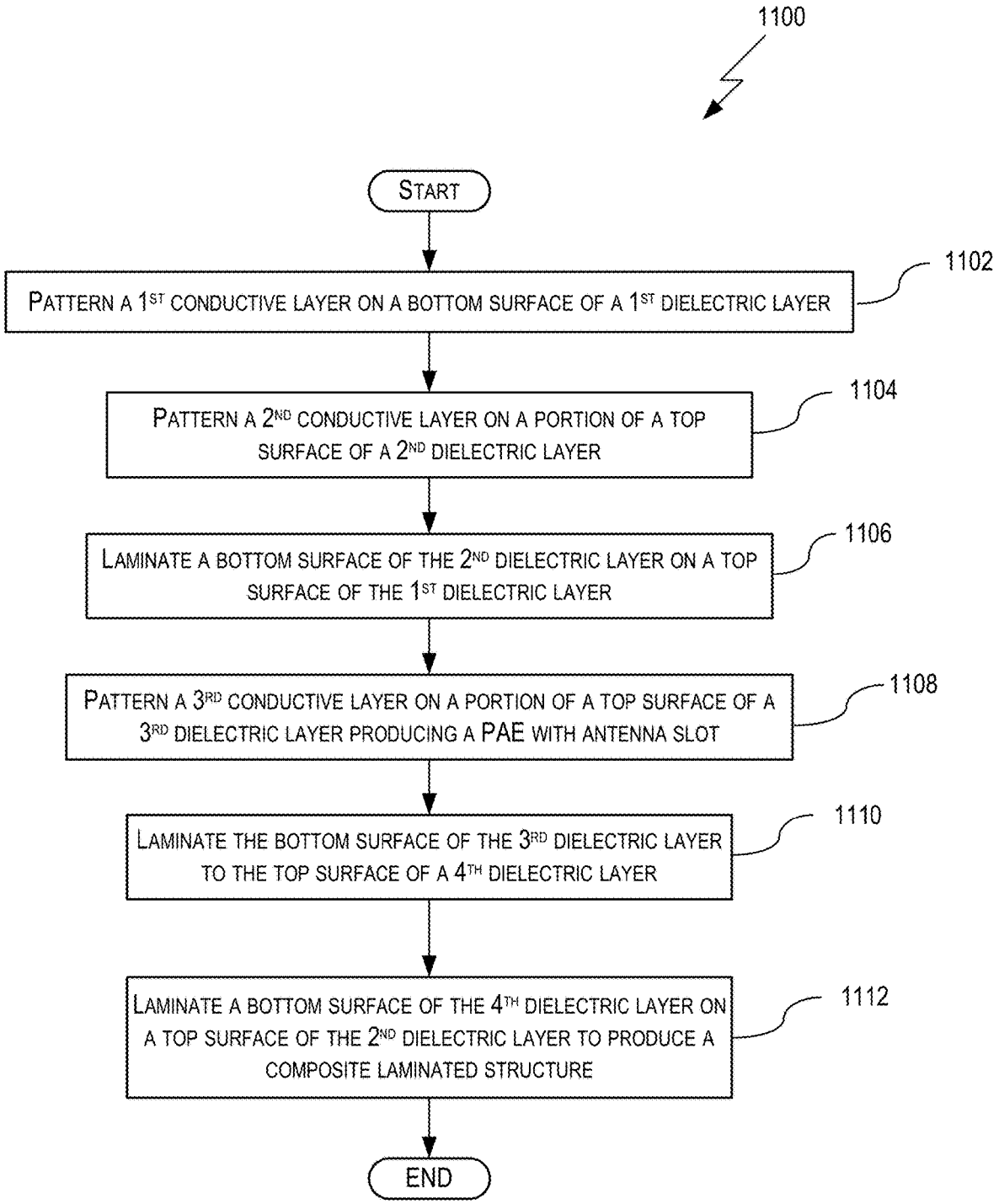
FIG. 11 is a flowchart of an example implementation of method for fabricating the LPCA (shown in FIGS. 1-7) utilizing a lamination process in accordance with the present disclosure.

In FIG. 11, a flowchart is shown of an example implementation of a method 1100 for fabricating the LPCA utilizing a lamination process in accordance with the present disclosure. The method 1100 is related to the method for fabricating the LPCA (i.e., LPCA 100, 500, or 600) utilizing the lamination process described in FIGS. 10A-10F. The method 1100 starts by patterning 1102 the first conductive layer 1004 on the bottom surface 1008 of the first dielectric layer 1002. The method 1100 additionally includes patterning 1104 the second conductive layer 1014 on the top surface 1016 of a second dielectric layer 1012 to produce an inner conductor 110. The method 1100 also includes laminating 1106 the bottom surface 1018 of the second dielectric layer 1012 to the top surface 1006 of the first dielectric layer 1002. The method 1100 also includes patterning 1108 the third conductive layer 1026 on the top surface 1028 of a third dielectric layer 1024 to produce the PAE 112 with the antenna slot 114. The method 1100 further includes laminating 1110 the bottom surface 1030 of the third dielectric layer 1024 to the top surface 1036 of the fourth dielectric 1034 to produce the second combination 1032. Moreover, the method 1100 includes laminating the bottom surface 1038 of the fourth dielectric layer 1034 to the top surface 1016 of the second dielectric layer 1012 producing the composite laminated structure 1040 that is also the dielectric structure (e.g., dielectric structure 104).

In this example, the method 1100 may utilize a sub-method where one or more of the first conductive layer 1014, second conductive layer 1014, and third conductive layer 1026 are formed by a subtractive method (e.g., wet etching, milling, or laser ablation) of electroplated or rolled metals or by an additive method (e.g., printing or deposition) of printed inks or deposited thin films. The method 1100 then ends.

In FIGS. 12A-12G, a method for fabricating the LPCA (i.e., LPCA 100, 500, or 600) utilizing an additive 3-D printing process is shown. Specifically, in FIG. 12A, a cross-sectional view of first section 1200 of the LPCA is shown in accordance with the present disclosure. The first section 1200 of the LPCA includes a printed first conductive layer 1202 with a top surface 1204 and a first width 1206, where the first width 1206 has a first center 1208.

Figure 12A:
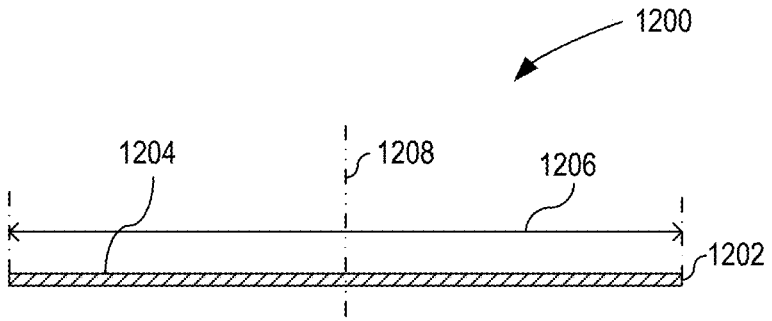
FIG. 12A is a cross-sectional view of a first section of the LPCA in accordance with the present disclosure.
Figure 12B:
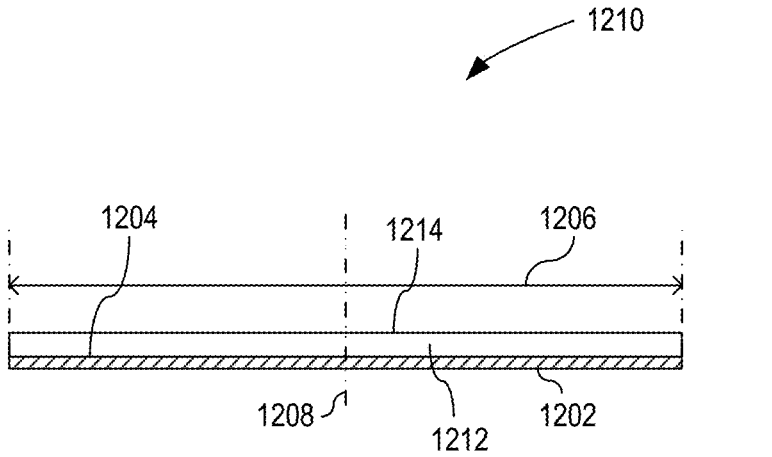
FIG. 12B is a cross-sectional view of a first combination of the first section and a printed first dielectric layer in accordance with the present disclosure.

In FIG. 12B, a cross-sectional view of a first combination 1210 of the first section 1200 with a printed first dielectric layer 1212 is shown in accordance with the present disclosure. In this example, the printed first dielectric layer 1212 with a top surface 1214 is printed on the top surface 1204 of the printed first conductive layer 1202.

Figure 12C:
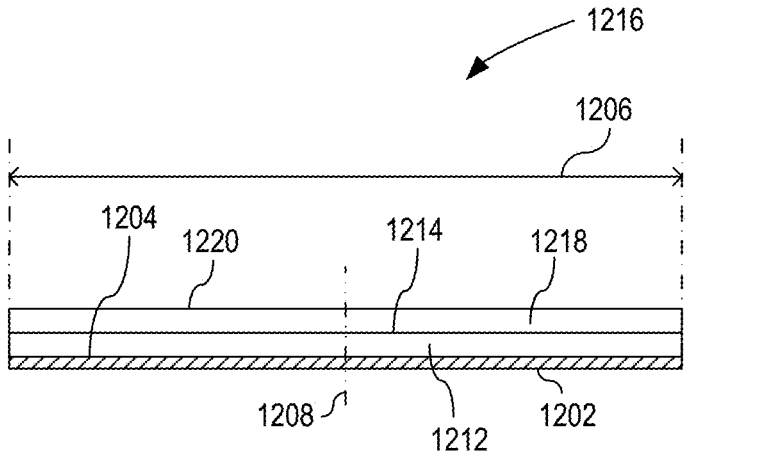
FIG. 12C is a cross-sectional view of a second combination of the first combination with a printed second dielectric layer in accordance with the present disclosure.

In FIG. 12C, a cross-sectional view of a second combination 1216 of the first combination 1210 with a printed second dielectric layer 1218 is shown in accordance with the present disclosure. In this example, the printed second dielectric layer 1218 with a top surface 1220 is printed on the top surface 1214 of the first dielectric layer 1212.

Figure 12D:
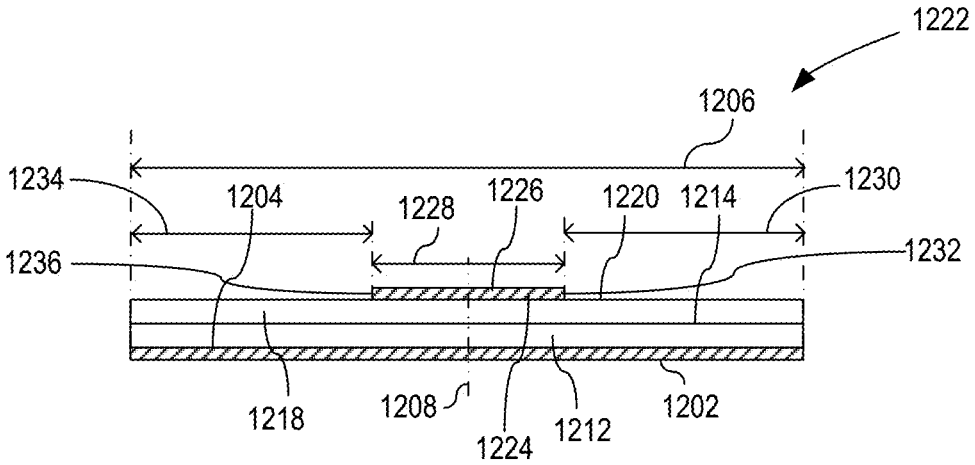
FIG. 12D is a cross-sectional view of a third combination of the second combination with a printed second conductive layer in accordance with the present disclosure.

In FIG. 12D, a cross-sectional view of a third combination 1222 of the second combination 1216 with a printed second conductive layer 1224 is shown in accordance with the present disclosure. Specifically, the printed second conductive layer 1224 with a top surface 1226 and second width 1228 less than the first width 1206 is printed on the top surface 1220 of the second dielectric layer 1218. In this example, the second width 1228 is less than the third width 1208. The second width 1228 results in a first gap 1230 at a first end 1232 of the second conductive layer 1224 and a second gap 1234 at a second end 1236 of the second conductive layer 1224, where the top surface 1220 of the second dielectric layer 1218 is exposed.

Figure 12E:
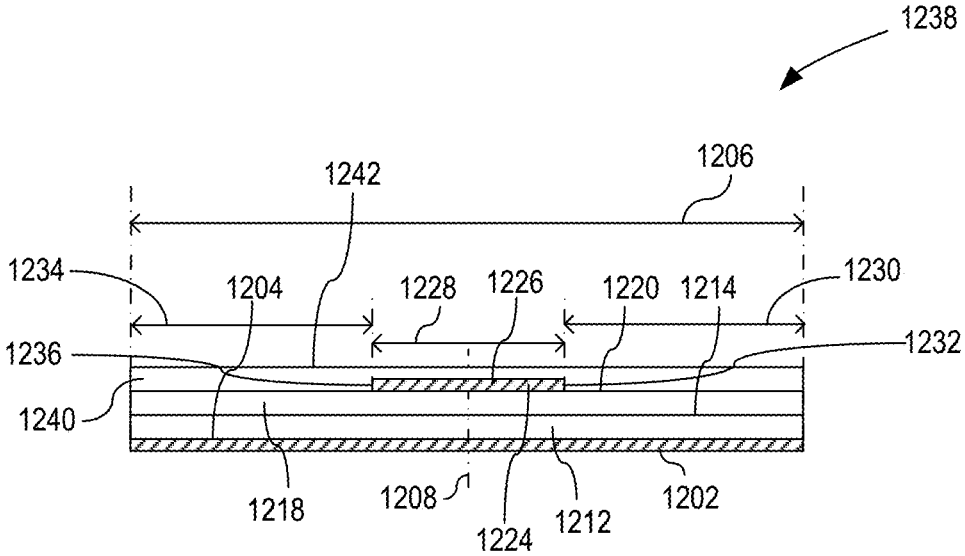
FIG. 12E is a cross-sectional view of a fourth combination of the third combination with a printed third dielectric layer in accordance with the present disclosure.

In FIG. 12E, a cross-sectional view of a fourth combination 1238 of the third combination 1222 with a printed third dielectric layer 1240 is shown in accordance with the present disclosure. Specifically, the printed third dielectric layer 1240 is printed on the top surface 1226 of the printed second conductive layer 1224 and the top surface 1220 of the printed second dielectric layer 1218 though the first gap 1230 and second gap 1234. In this example, the printed third dielectric layer 1240 has a top surface 1242.

Figure 12F:
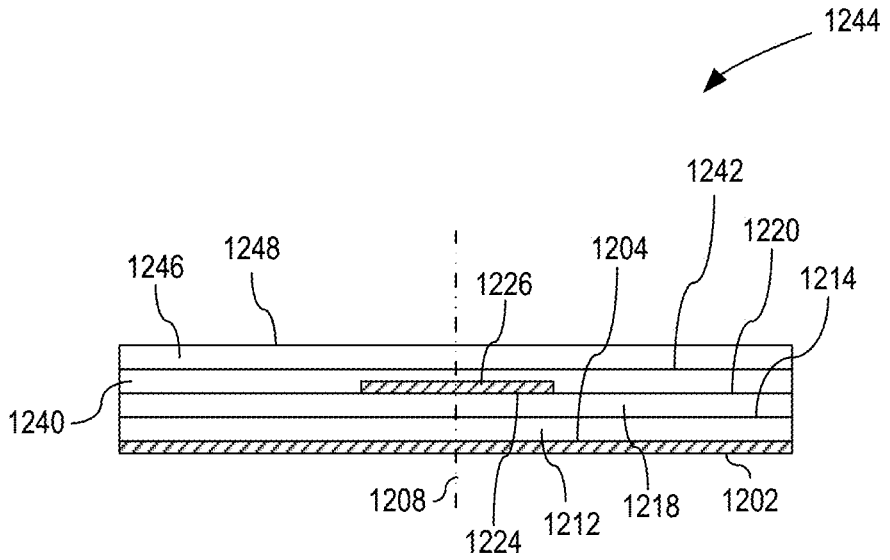
FIG. 12F is a cross-sectional view of a fifth combination of the fourth combination with a printed fourth dielectric layer in accordance with the present disclosure.

In FIG. 12F, a cross-sectional view of a fifth combination 1244 is shown in accordance with the present disclosure. The fifth combination 1244 is a combination of the fourth combination 1238 and a printed fourth dielectric layer 1246. Specifically, the printed fourth dielectric layer 1246 has a top surface 1248 and is printed on the top surface 1242 of the printed third dielectric layer 1240.

Figure 12G:
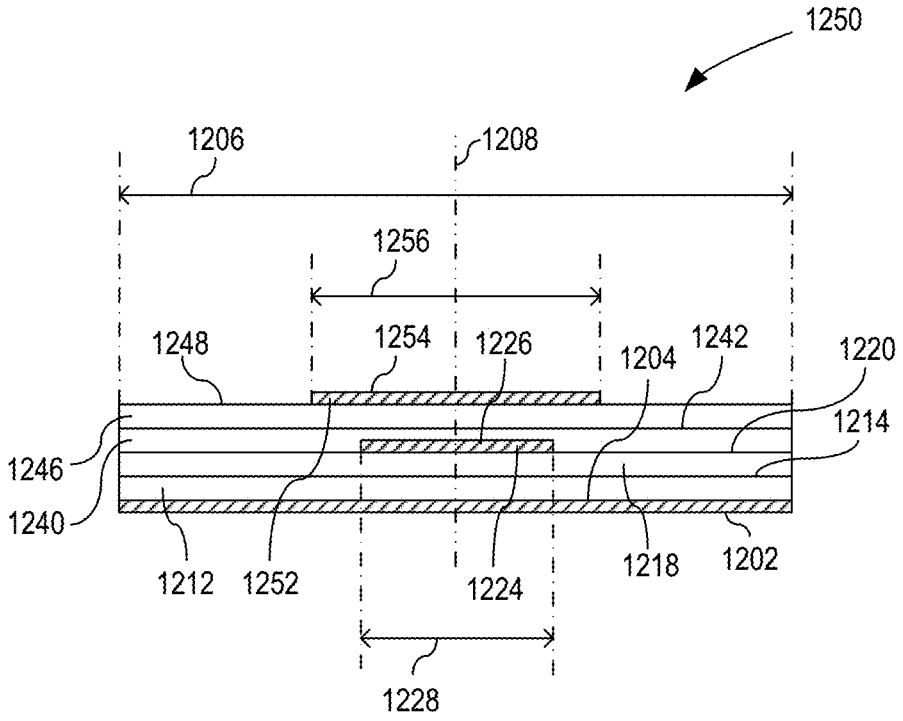
FIG. 12G is a cross-sectional view of the sixth combination of the fifth combination and a printed third conductive layer in accordance with the present disclosure.

In FIG. 12G, a cross-sectional view of the sixth combination 1250 of the fifth combination 1244 and a printed third conductive layer 1252 is shown in accordance with the present disclosure. Specifically, a printed third conductive layer 1252 with a top surface 1254 and a third width 1256 less than the first width 1206 is printed on a portion of the top surface 1248 of the printed fourth dielectric layer 1246 to produce the PAE 112 with antenna slot 114. In this example, if the shape of the third conductive layer 1252 may be circular and the third width 1256 may be equal to the radius 302 shown in FIG. 3. It is appreciated by those skilled in the art that the sixth combination 1250 is an example of an implementation of the dielectric structure 104.

Figure 13:
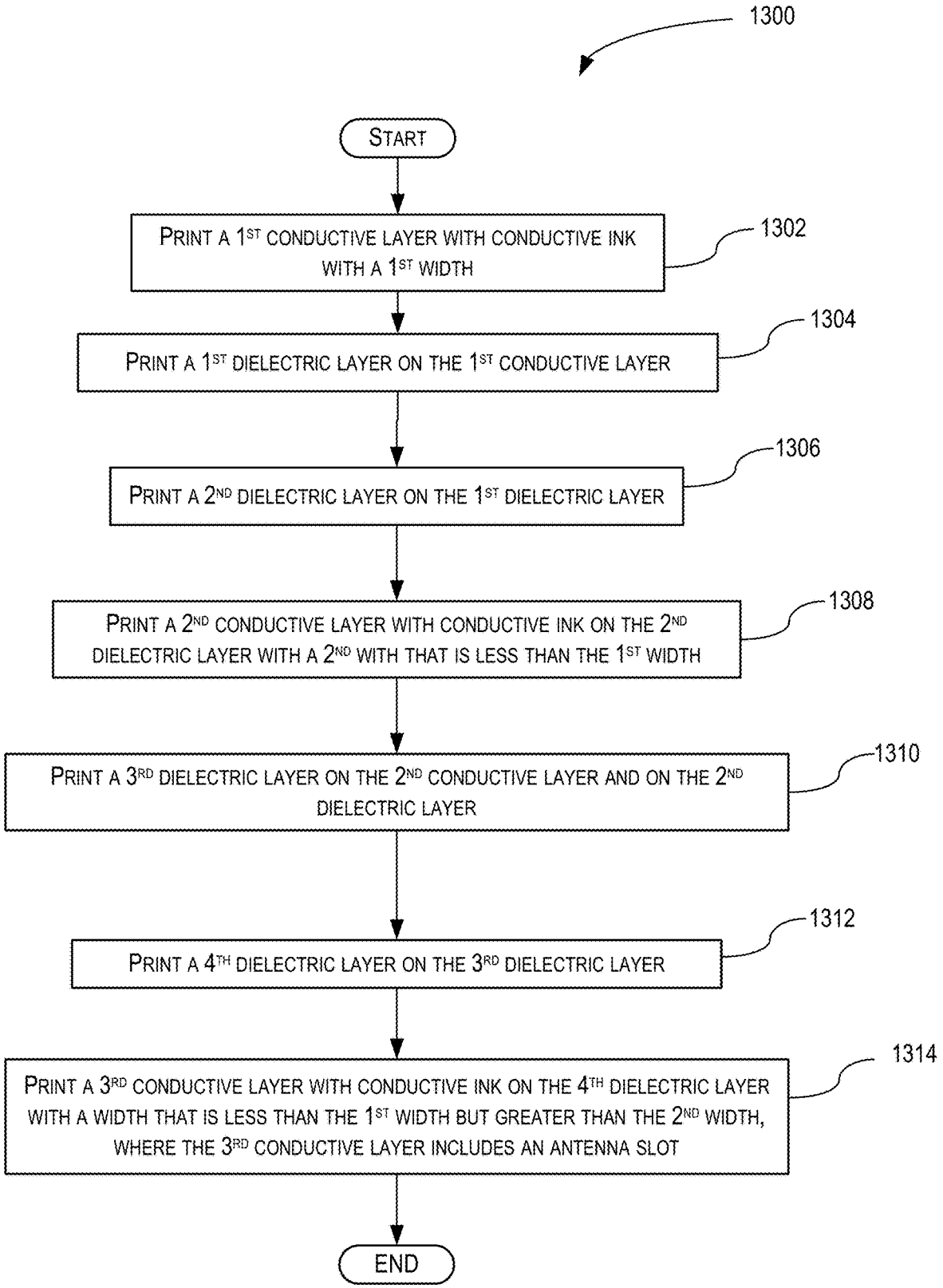
FIG. 13 is a flowchart of an example implementation of a method for fabricating the LPCA utilizing an additive three-dimensional ("3-D") printing process in accordance with the present disclosure.

In FIG. 13, a flowchart is shown of an example implementation of method 1300 for fabricating the LPCA (i.e., either LPCA 100, 500, or 600) utilizing a three-dimensional ("3-D") additive printing process in accordance with the present disclosure. The method 1300 is related to the stack up method for fabricating the LPCA (i.e., LPCA 100, 500, or 600) utilizing the additive 3-D printing process is shown in FIGS. 12A-12G.

The method 1300 starts by printing 1302 the first conductive layer 1202. The first conductive layer 1202 includes the top surface 1204 and first width 1206 with a first center 1208. The method 1300 then includes printing 1304 the first dielectric layer 1212 with a top surface 1214 on the top surface 1204 of the first conductive layer 1202.

The method 1300 then includes printing 1306 the second dielectric layer 1218 with a top surface 1220 on the top surface 1214 of the first dielectric layer 1212. The method 1300 then includes printing 1308 the second conductive layer 1224 with a top surface 1226 and a second width 1228 less than the first width 1206 on the surface 1220 of the second dielectric layer 1218.

The method 1300 further includes printing 1310 the third dielectric layer 1240 with a top surface 1242 on the top surface 1226 of the second conductive layer 1224 and on the top surface 1220 on the second dielectric layer 1218. The method 1300 then includes printing 1312 the fourth dielectric layer 1246 with a top surface 1248 on the top surface 1242 of the third dielectric layer 1240. Moreover, the method 1300 includes printing 1314 the third conductive layer 1252 with a top surface 1254 and a third width 1256 less than the first width 1206 on the top surface 1248 of the fourth dielectric layer 1246. The method 1300 then ends.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A low-profile conformal antenna ("LPCA") comprising:

a plurality of dielectric layers forming a dielectric structure, wherein a first dielectric layer of the plurality of dielectric layers includes a first surface, wherein a second dielectric layer of the plurality of dielectric layers has a second surface opposite the first surface;

a conductive layer formed on the second surface;

an inner conductor formed between the first surface and the second surface, the inner conductor disposed between a third dielectric layer of the plurality of dielectric layers and a fourth dielectric layer of the plurality of dielectric layers, wherein the inner conductor is configured to have a first polarity and wherein the conductive layer is configured to have a second polarity different than the first polarity;

a patch antenna element ("PAE") formed on the first surface and having an antenna slot, wherein the PAE includes a conductor, and wherein the inner conductor is configured to receive a transverse electromagnetic ("TEM") signal for transmission by the PAE; and a second PAE formed on the first surface and having a second antenna slot, wherein the second PAE includes a second conductor, and wherein the inner conductor is contiguous between the PAE and second PAE.

2. The LPCA of claim 1, wherein the inner conductor has a width along a first axis of a plane, the width less than a diameter of the PAE, wherein the inner conductor has a length along a second axis of a plane, the length greater than the diameter of the PAE, and wherein the plane is parallel with the first surface.

3. The LPCA of claim 1, wherein the PAE is circular and has a radius, wherein the antenna slot has a slot length, and wherein the radius of the PAE and slot length are predetermined to optimize a radiated signal of the PAE with the antenna slot at a predetermined operating frequency.

4. The LPCA of claim 1, wherein the antenna slot is non-parallel with a major axis of the inner conductor.

5. The LPCA of claim 1, wherein each dielectric layer of the plurality of dielectric layers includes a dielectric laminate material.

6. The LPCA of claim 1, wherein the dielectric structure has a stack-up height, wherein the dielectric structure has a width, wherein the inner conductor is located in a middle dielectric layer within the dielectric structure that is approximately at a center position that is equal to approximately half of the stack-up height, and wherein the inner conductor has an inner conductor center that is located within the dielectric structure, wherein the inner conductor center is approximately at a second center position equal to approximately half of the width of the dielectric structure.

7. The LPCA of claim 1, wherein each dielectric layer of the plurality of dielectric layers includes a dielectric laminate material, and wherein the inner conductor includes a stripline or microstrip conductor.

8. The LPCA of claim 1, further comprising:

a second inner conductor, a power divider electrically connected to an input port, to the inner conductor, and to the second inner conductor.

9. The LPCA of claim 8, further comprising: a third PAE on the first surface with a third antenna slot, wherein the third PAE and the third antenna slot are located on the first surface above the second inner conductor.

10. The LPCA of claim 9, further comprising a fourth PAE on the first surface with a fourth antenna slot, wherein the fourth PAE and the fourth antenna slot are located on the first surface above the second inner conductor, and wherein the inner conductor and second inner conductor include a stripline or microstrip conductor.

11. The LPCA of claim 1, further comprising an input port including the inner conductor and the conductive layer.

12. The LPCA of claim 11, wherein the inner conductor is configured to receive a first voltage associated with the TEM signal, wherein the bottom conductive layer is configured to receive a second voltage associated with the TEM signal, and wherein the first voltage is greater than the second voltage.

13. A method for fabricating a low-profile conformal antenna ("LPCA") utilizing a lamination process, the method comprising:

patterning a first conductive layer on a bottom surface of a first dielectric layer having a top surface and the bottom surface to produce a ground plane;

patterning a second conductive layer on a top surface of a second dielectric layer having the top surface and a bottom surface to produce an inner conductor;

laminating the bottom surface of the second dielectric layer to the top surface of the first dielectric layer;

patterning a third conductive layer on a top surface of a third dielectric layer having the top surface and a bottom surface, wherein the third conductive layer forms a patch antenna element ("PAE") with an antenna slot, wherein the third conductive layer forms a second PAE having a second antenna slot;

laminating the bottom surface of the third dielectric layer to a top surface of a fourth dielectric layer, wherein the fourth dielectric layer has a bottom surface; and laminating the bottom surface of the fourth dielectric layer to the top surface of the second dielectric layer to produce a composite laminated structure, wherein the inner conductor is contiguous between the PAE and the second PAE.

14. The method of claim 13, wherein the first conductive layer, the second conductive layer, and the third conductive layer include conductive metals.

15. The method of claim 14, wherein at least one of the first conductive layer, the second conductive layer, and the third conductive layer is formed by a subtractive method of electroplated or rolled metals that includes wet etching, milling, or laser ablation or by an additive method of printed inks or deposited thin-films.

16. An LPCA produced by the method of claim 13.

17. The LPCA of claim 16, wherein the antenna slot is non-parallel with a major axis of the inner conductor.

18. A method for fabricating a low-profile conformal antenna ("LPCA") utilizing a three-dimensional ("3-D") additive printing process, the method comprising:

printing a first conductive layer having a top surface and a first width;

printing a first dielectric layer on the top surface of the first conductive layer, wherein the first dielectric layer has a top surface;

printing a second dielectric layer on the top surface of the first dielectric layer, wherein the second dielectric layer has a top surface;

printing a second conductive layer on the top surface of the second dielectric layer, wherein the second conductive layer has a top surface and a second width, and wherein the second width is less than the first width;

printing a third dielectric layer on the top surface of the second conductive layer and on the top surface on the second dielectric layer, wherein the third dielectric layer has a top surface;

printing a fourth dielectric layer on the top surface of the third dielectric layer, wherein the fourth dielectric layer has a top surface; and printing a third conductive layer on the top surface of the fourth dielectric layer, wherein the third conductive layer forms a patch antenna element ("PAE"), wherein the third conductive layer has a top surface and a third width, wherein the third width is less than the first width, wherein the third conductive layer includes an antenna slot within the third conductive layer that exposes the top surface of the fourth dielectric layer through the third conductive layer, wherein the third conductive layer forms a second PAE having a second antenna slot, and wherein the second conductive layer is contiguous between the PAE and the second PAE.

19. A LPCA produced by the method of claim 18.

20. The LPCA of claim 19, wherein the second conductive layer includes an inner conductor, and wherein the antenna slot is non-parallel with a major axis of the inner conductor.

* * * * *